US007354690B2

(12) United States Patent
Ishii et al.

(10) Patent No.: US 7,354,690 B2
(45) Date of Patent: Apr. 8, 2008

(54) TONER AND METHOD FOR PRODUCING THE SAME, AND, DEVELOPER, TONER-CONTAINING CONTAINER, PROCESS CARTRIDGE, IMAGE FORMING APPARATUS AND IMAGE FORMING METHOD

(75) Inventors: Masayuki Ishii, Numazu (JP); Chiaki Tanaka, Shizuoka (JP); Nahiro Watanabe, Shizuoka (JP); Kei Naitoh, Shizuoka (JP); Takuya Saito, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/522,936

(22) Filed: Sep. 19, 2006

(65) Prior Publication Data

US 2007/0037085 A1 Feb. 15, 2007

Related U.S. Application Data

(63) Continuation of application No. PCT/JP2005/004754, filed on Mar. 17, 2005.

(30) Foreign Application Priority Data

| | | | |
|---|---|---|---|
| Mar. 19, 2004 | (JP) | ..... | 2004-081757 |
| Jun. 16, 2004 | (JP) | ..... | 2004-178556 |
| Mar. 15, 2005 | (JP) | ..... | 2005-072991 |

(51) Int. Cl.
*G03G 9/113* (2006.01)

(52) U.S. Cl. ..... 430/137.11; 430/110.2

(58) Field of Classification Search ..... 430/110.2, 430/137.11, 37.11
See application file for complete search history.

(56) References Cited

U.S. PATENT DOCUMENTS

| | | | | |
|---|---|---|---|---|
| 5,487,965 | A * | 1/1996 | Odell | 430/137.22 |
| 5,725,987 | A * | 3/1998 | Combes et al. | 430/137.11 |
| 6,426,116 | B1 * | 7/2002 | Sunol | 427/217 |
| 6,858,369 | B1 * | 2/2005 | Adachi et al. | 430/137.11 |
| 2005/0277044 | A1 | 12/2005 | Watanabe et al. | |
| 2005/0277045 | A1 | 12/2005 | Saito et al. | |
| 2007/0031750 | A1 * | 2/2007 | Tanaka et al. | 430/111.1 |

FOREIGN PATENT DOCUMENTS

| | | |
|---|---|---|
| JP | 06-186772 | 7/1994 |
| JP | 06-332229 | 12/1994 |
| JP | 2001-312098 | 11/2001 |
| JP | 2002-082490 | 3/2002 |
| JP | 2003-021933 | 1/2003 |
| JP | 2004-503603 | 2/2004 |
| WO | WO 02/05944 | 1/2002 |

OTHER PUBLICATIONS

U.S. Appl. No. 11/752,343, filed May 23, 2007, Nagatomo et al.

* cited by examiner

*Primary Examiner*—John L Goodrow
(74) *Attorney, Agent, or Firm*—Oblon, Spivak, McClelland, Maier & Neustadt, P.C.

(57) ABSTRACT

A toner producing method is provided, which comprises preparing toner base particles in an aqueous medium, wherein the toner base particles comprise resin fine particles, and forming a coating layer on the surface of the toner base particles, wherein the coating layer is formed by attaching or coating a toner functional substance onto the surface of the toner base particles using at least one of supercritical fluids and sub-supercritical fluids.

15 Claims, 6 Drawing Sheets

TONER AND METHOD FOR PRODUCING THE SAME, AND, DEVELOPER, TONER-CONTAINING CONTAINER, PROCESS CARTRIDGE, IMAGE FORMING APPARATUS AND IMAGE FORMING METHOD

CROSS-REFERENCE TO RELATED APPLICATIONS

This is a continuation of Application No. PCT/JP05/04754, filed on Mar. 17, 2005.

BACKGROUND OF THE INVENTION

1. Field of the Invention

The present invention relates to toners utilized for electrophotographic processes, electrostatic recording processes, electrostatic recording processes, electrostatic printing processes or the like; efficient production methods of the toners; and developers, toner-containing containers, process cartridges, image forming apparatuses and image forming methods that utilize the toners respectively.

2. Description of the Related Art

Electrophotographic processes involve generally a latent electrostatic image forming step in which latent electrostatic images are formed on a photoconductor containing-photoconducive substances by various means, a developing step in which toner images are formed by use of toners, a transfer step in which the toner images are transferred on recording media such as paper, a fixing step in which toner images transferred on the recording media are fixed on the recording media by action of heat, pressure, hot press, solvent vapors or the like, a cleaning step in which toners remaining on the photoconductor surface are removed, and the like.

The toners used in the electrophotographic processes are demanded to be produced by more energy-saving, environment-friendly processes. Conventionally, the toners have been produced by melting, mixing and pulvelizing processes; in recent years, polymerization processes in liquid solvents are mainly employed, such as emulsion aggregation processes, emulsion polymerization processes and dispersion polymerization processes. Among the polymerization toners produced by these polymerization processes, functional toners referred to as capsule toners or core shell toners are provided that have a certain configuration to provide efficiently desirable functions from the viewpoint on recent environmental issues.

In the toner producing methods through the melting, mixing and pulvelizing processes, it is important that the respective constitutional materials are uniformly dispersed and pulverized for making uniform the shape of resulting toners. Essentially, the shape of pulvelized toners is non-uniform and the surfaces are randomly fractured, therefore, the shape and the configuration are remarkably difficult to control. Furthermore, when a great deal of colorants, release agents and charge control agents are added, these additives tend to expose at surfaces due to cleavage at their crystal faces, which possibly induces problems of quality degradation due to polarization of coloring, releasing and charging properties in respective particles.

On the other hand, the toner producing methods through the polymerization processes may provide toners with higher qualities than those of the pulverizing processes described above; however, there exist such problems that the droplets are difficult to control into optional sizes in dispersion solvents, margin of employable materials is relatively narrow, and coloring, releasing and charging properties are liable to deviate due to polarization of the components in the toners.

In view of these problems, Japanese Patent Application Laid-Open (JP-A) No. 2003-21933 discloses a method for producing a toner uniformly containing sufficient amounts of colorants, charge control agents and release agents, in which at least one of colorants, charge control agents and waxes is dispersed in water by use of polymerization initiators, to thereby prepare an aqueous dispersion containing micelles of these ingredients before emulsion polymerization or soap-free emulsion polymerization by use of polymerization initiators having a surface activity and a structure with a hydrophilic site, a hydrophobic site and also a polymerization initiation site therebetween.

However, uniform dispersion and deposition of colorants, charge control agents and release agents cannot be attained sufficiently even the toner production method described in JP-A No. 2003-21933 is employed, thus the developing properties including the lifetime is not sufficiently satisfactory.

Accordingly, such technologies have not be provided yet that can form coating layers of optional materials on toner base particles produced by conventional methods, and can provide the toner base particles with more uniform charging capacities and surface properties, and also can sufficiently solve problems induced by polarization of the colorants, release agents, charge control agents and the like.

SUMMARY OF THE INVENTION

It is an object of the present invention to provide a toner, in which the toner has a coating layer on the surface of toner base particles, the coating layer is coated using at least one of supercritical fluids and sub-supercritical fluids, the toner is superior in coloring property, mold-release property, charging capability and surface nature, and the coating layer is thin and uniform; another object of the present invention is to provide a toner producing method with higher efficiencies and less environmental load; the other objects are to provide a developer, toner-containing container, process cartridge, image forming apparatus and image forming method respectively capable of producing high-quality images by use of the toner.

The present inventors have investigated vigorously to solve the problems described above and have taken the following findings: that is, toner functional substances such as colorants, resins, release agents and charge control agents are dissolved in at least one of supercritical fluids and sub-supercritical fluids for a material to coat the surface of toner base particles, then the toner base particles are processed within the fluid for a predetermined period, thereby a thin and uniform coating layer can be formed with substantially no pinholes on the surface of toner base particles, which can provide superior coloring, release and charge control properties with the resulting toners.

The toner producing method according to the present invention comprises a step of producing toner base particles in which toner base particles containing at least resin fine particles are produced by forming particles in an aqueous medium, and a step of forming a coating layer in which the coating layer is formed by depositing or coating toner functional substances on the surface of toner base particles by use of at least one of supercritical fluids and sub-supercritical fluids. In the toner producing method according to the present invention, the coating layer is formed by use of at least one of supercritical fluids and sub-supercritical fluids on the surface of toner base particles by attaching or coating toner functional substances thereby to form the coating layer in the step of forming the coating layer. Consequently, the toner is produced with the thin and uniform layer with substantially no pinholes, which can provide superior coloring, release and charge control properties with toners.

The toner according to the present invention is produced by the toner producing method according to the present invention, therefore, is superior in coloring property, mold-release property, charging capability and surface nature.

The developer according to the present invention contains the toner according to the present invention, therefore, the images formed by electrophotography using the developer may bring about high-quality images with superior coloring, release properties and charge capacity, and also higher image density and clearness.

The toner-containing container according to the present invention contains the toner according to the present invention, therefore, the images formed by electrophotography using the toner contained in the toner-containing container may bring about high-quality images with superior coloring, release properties and charge capacity, and also higher image density and clearness.

The process cartridge according to the present invention possesses at least a latent image bearing member, and a developing unit configured to form visible images through developing latent electrostatic images formed on the latent image bearing member by use of the toner according to the present invention. Consequently, the process cartridge is detachable to image forming apparatuses and affords excellent usability; furthermore, high-quality images with superior coloring, release properties and charge capacity, and also higher image density and clearness may be taken since the toner according to the present invention is used.

The image forming apparatus according to the present invention comprises at least a latent electrostatic image bearing member, a latent electrostatic forming unit configured to form latent electrostatic images on the latent electrostatic image bearing member, a developing unit configured to form visible images through developing latent electrostatic images by use of the toner according to the present invention, a transfer unit configured to transfer the visible images on recording media, and a fixing unit configured to fix the images transferred on the recording media. In the image forming apparatus according to the present invention, the latent electrostatic image forming unit forms latent electrostatic images on the latent electrostatic image bearing member. The developing unit forms visible images through developing latent electrostatic images by use of the toner according to the present invention. The fixing unit fixes the images transferred on the recording media. Consequently, high-quality images may be taken with superior coloring, release properties and charge capacity, and also higher image density and clearness.

The image forming method according to the present invention comprises a latent electrostatic forming step for forming latent electrostatic images on the latent electrostatic image bearing member, a developing step for forming visible images through developing latent electrostatic images by use of the toner according to the present invention, a transfer step for transferring the visible images on recording media, and a fixing step for fixing the images transferred on the recording media. In the image forming method according to the present invention, the latent electrostatic images are formed on the latent electrostatic image bearing member in the latent electrostatic forming step. In the developing step, the latent electrostatic images are developed by use of the toner according to the present invention thereby to form visible images; in the transfer step, the visible images are transferred on recording media; and in the fixing step, the images transferred on the recording media are fixed. Consequently, high-quality images may be taken with superior coloring, release properties and charge capacity, and also higher image density and clearness.

DESCRIPTION OF THE PREFERRED EMBODIMENTS

Toner and Toner Producing Method

Figure 1:
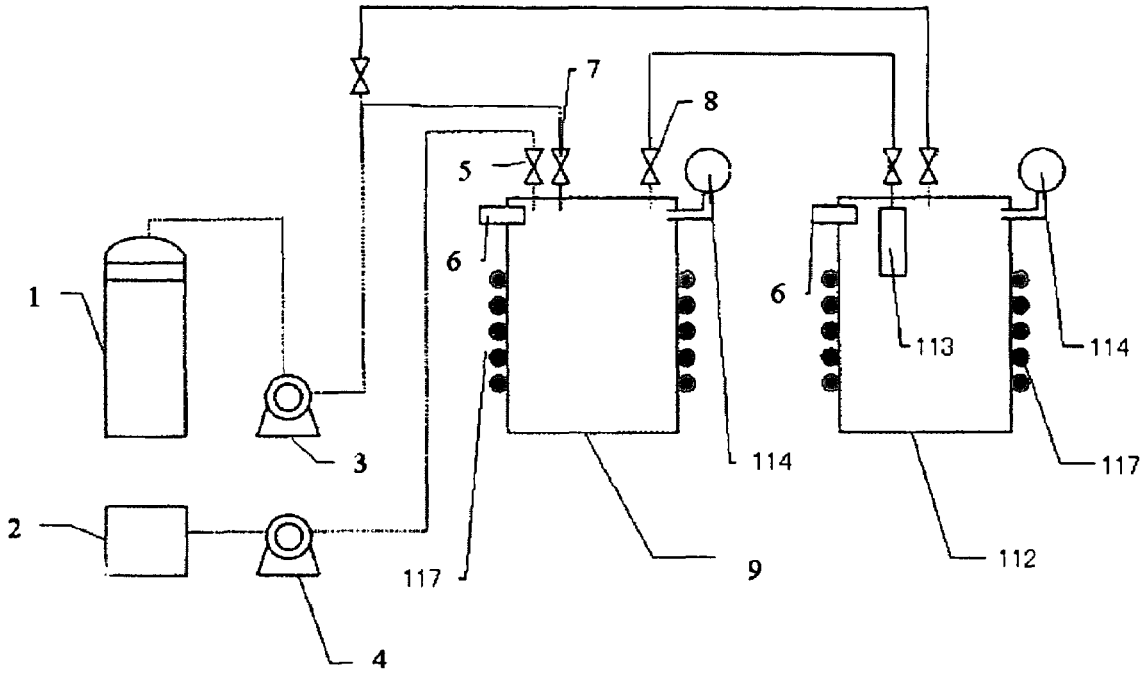
FIG. 1 is a schematic view that shows exemplarily an apparatus utilized in a step of forming a coating layer in accordance with the present invention.

The toner producing method according to the present invention includes a step of producing toner base particles, a step of forming a coating layer, and other steps selected as required.

It is preferred that the step of forming a coating layer involves at least one of a step of forming a colorant-coating layer, a step of forming a resin-coating layer, a step of forming a charge control agent-coating layer, and a step of forming a release agent-coating layer. The toner according to the present invention can be produced by the toner producing method according to the present invention described above.

The details of the toner according to the present invention will be apparent through the explanation of the toner producing method according to the present invention.

Step of Producing Toner Base Particles

In the step of producing toner base particles, toner base particles containing at least resin fine particles are produced by forming the particles in an aqueous medium. The term "toner base particles" refers to toners of various situations other than final toners, that is, the term include resin fine particles needless to say, and also resin fine particles coated with at least one of a colorant-coating layer, a resin-coating layer, a charge control agent-coating layer, a release agent-coating layer, and other layers.

The aqueous medium may be properly selected from conventional ones; examples thereof include water, a variety of solvents miscible with water, and mixtures thereof. Among these, water is preferable in particular.

Examples of the solvents miscible with water may be properly selected as long as being miscible with water; examples thereof include alcohols, dimethylformamide, tetrahydrofuran, cellosolves, and lower ketones.

Examples of the alcohols include methanol, isopropanol and ethyleneglycol. Examples of the lower ketones include acetone and methylethyketone. These may be used alone or in combination of two or more.

The resin fine particles within the toner base particles may be properly selected as long as the resin fine particles are usable for image forming; examples of the resin fine particles are those produced by milling processes and polymerization processes. The polymerization processes may be properly selected depending on the application; examples thereof include suspension processes, emulsion processes and dispersion processes.

The toner may be those produced by microcapsulation processes such as spray-dry processes and coacervation in addition to those produced by milling processes and polymerization processes. The resin fine particles may be appropriately synthesized or commercially available.

In the milling processes, materials containing at least a binder resin are melted-mixed, then milled, classified or the like to thereby produce the toner base particles. In the milling processes, the resulting toner base particles are adjusted in terms of their shape by applying a mechanical impulse force in order to increase the average circularity of the toner. The mechanical impulse force may be applied to the toner base particles by use of apparatuses such as a hybritizer and mechanofusion.

The resin fine particles obtained by the polymerization processes may be those of vinyl resins, polyurethane resins, epoxy resins, polyester resins, polyamide resins, polyimide resins, silicon resins, phenol resins, melamine resins, urea resins, aniline resins, ionomer resins and polycarbonate resins. The vinyl resins as used herein encompass polymers obtained through homopolymerization or copolymerization of vinyl monomers; specific examples thereof include styrene-(meth)acrylate resins, styrene-butadiene copolymers, (meth)acrylic acid-acrylate polymers, styrene-acrylonitrile copolymers, styrene-maleic anhydride copolymers and styrene-(meth)acrylic acid copolymers.

In addition, resin fine particles formed of polycondensation resins or thermosetting resins, produced by soap-free emulsification polymerization, suspension polymerization or dispersion polymerization, such as polystyrene, methacrylate-acrylate copolymers, silicone resins, benzoguanamine and nylon may be preferable in view of narrower particle size distributions. Among these, resin fine particles obtained through dispersion polymerization are preferable in view of still narrower particle size distributions. In addition, provided that the toner being afforded with fixing ability at lower temperatures, resin fine particles may be selected from those formed of polyester resins or polyol resins; and the resins may be selected in combination with the design of desirable toner base particles.

The dispersion polymerization will be specifically explained below.

Initially, a dispersant of polymer compound soluble into a hydrophilic organic liquid is added to the hydrophilic organic liquid, then one or more of vinyl monomers, which being soluble into the hydrophilic organic liquid and of which the polymer being merely swellable or hardly soluble, is added to the mixture to thereby form particles. The reaction may be those that produce initially a polymer with a particle size smaller than an intended particle size then grow the particle size in the reaction. The monomer utilized in this growth reaction may be the same or different with that of the initial reaction as long as the resulting polymer is insoluble into the hydrophilic organic liquid. The polymer dispersion obtained by the process may be utilized as it is in the next step of forming a coating layer, which therefore is attributable for simplification of production processes.

The hydrophilic organic liquid is selected from those soluble for the employed vinyl monomers and insoluble for the resulting resin fine particles or polymer particles. Examples of the liquid include water, alcohols such as methyl alcohol, ethyl alcohol, modified ethyl alcohol, isopropyl alcohol, n-butyl alcohol, isobutyl alcohol, tert-butyl alcohol, sec-butyl alcohol, tert-amyl alcohol, 3-pentanol, octyl alcohol, benzyl alcohol, cyclohexanol, furfuryl alcohol, ethylene glycol, glycerin and diethylene glycol; ether alcohols such as methyl cellosolve, cellosolve, isopropyl cellosolve, butyl cellosolve, ethyleneglycol monomethylether, ethyleneglycol monoethylether, diethylene glycol monomethylether and diethyleneglycol monoethylether. These organic liquids may be used alone or in combination. When organic liquids other than the alcohols and ether alcohols are combined with the alcohols and/or ether alcohols described above, organic liquids may be prepared with various SP values which provide insoluble conditions for resulting polymer particles, thus the resulting particle size, particle coagulation, and generation of other particles may possibly be controlled.

Examples of the organic liquids other than the alcohols and ether alcohols include hydrocarbons such as hexane, octane, petroleum ether, cyclohexane, benzene, toluene and xylene; halogenated hydrocarbons such as carbon tetrachloride, trichloroethylene and tetrabromoethane; ethers such as ethylether, diethylene glycol, trioxane and tetrahydrofuran; acetals such as methylal and diethylene acetal; ketones such as acetone, methylethylketone and methylisobutylketone; esters such as butyl formate, butyl acetate, ethyl propionate and cellosolve acetate; acids such as formic acid, acetic acid and propionic acid; and sulfur or nitrogen-containing organic compounds such as nitropropene, nitrobenzene and dimethylamine.

The solvents based on the hydrophilic organic liquids described above may be included inorganic ions such as $SO_4^{2-}$, $NO_2^-$, $PO_4^{3-}$, $Cl^-$, $Na^+$, $K^+$, $Mg^{2+}$ and $Ca^{2+}$, then the polymerization may be carried out under the presence of the inorganic ions. In addition, the average particle diameter, particle size distribution and drying condition may be controlled through changing the species and composition of the mixture solvents at starting, intermediate and terminal polymerization stages.

The dispersants of polymer compounds described above may be properly selected depending on the application; examples thereof include acids such as acrylic acid, methacrylic acid, α-cycnoacrylic acid, α-cycnomethacrylic acid, itaconic acid, crotonic acid, fumaric acid, maleic acid and maleic anhydride; acrylic monomers; vinyl alcohols; ethers of vinyl alcohols; esters of vinyl alcohols and compounds having a carboxyl group; acryl amide, methacryl amide, diacetone acrylic amide, or methylol compounds thereof; acid chlorides such as acrylic chloride and methacrylic chloride; heterocyclic compounds; homopolymers or copolymers of monomers described above; polyoxyethylene resins and celluloses.

The dispersants of polymer compounds described above may be properly selected depending on the hydrophilic organic liquid, the intended seeds of polymer particles, and producing process of seed or growth particles. Particularly, the dispersant of polymer compound may be selected from the viewpoint of higher affinity and adsorbability to the surface of polymer particles and also higher affinity and solubility with the hydrophilic organic liquid in order to prevent sterically the coagulation of polymer particles. In addition, the compounds having molecular chains with a certain length and a molecular weight of no less than 10,000 in particular is preferable so as to enhance the three-dimensional repulsion of particles. However, excessively higher molecular weights may lead to remarkable increase of liquid viscosity and degrade operationability and processability, resulting in significant fluctuation in deposition of produced polymers onto the particle surface. The monomer of the dispersant of polymer compound may exist effectively together with the monomer of polymer particles to stabilize the dispersion.

The content of the dispersant of polymer compound at producing the seed particles typically depends on the monomer for the polymer particles; preferably, the content is 0.1% by mass to 10% by mass based on the hydrophilic organic liquid, more preferably 1% by mass to 5% by mass. The higher concentrations of the dispersant of polymer compound tend to bring about polymer particles with larger sizes, and lower concentrations tend to bring about polymer particles with smaller sizes; in general, the concentrations of no less than 10% by mass tend to hardly effect to decrease the particle size.

The usage of fine particles of organic compounds or surfactants in addition to the dispersant of polymer compound may further stabilize the resulting polymer particles and improve the particle size distribution; these fine particles of organic compounds or surfactants may exist with the vinyl monomer solution or seed particle dispersion and then the polymerization may be carried out, for preventing the coagulation of particles at the growth reaction. The particles at the initial stage may be stabilized by a polymer dispersant that is distributed in equilibrium in the hydrophilic organic liquid and to the surface of polymer particles. When an unreacted vinyl monomer exists within the hydrophilic organic liquid in significant amounts, the particles at the initial stage may be somewhat swelled and be cohesive, thus coagulation thereof may occur while overcoming the three-dimensional impulse by virtue of polymer dispersants.

When the amount of monomer is extremely large in relation to the hydrophilic organic liquid, the particles delay the deposition until the polymerization progresses some degrees since the resulting polymer dissolves. In such cases, the deposition tents to appear in a condition of viscous mass blocks. As such, the amount of monomer at producing the resin fine particles is preferably no more than 100% by mass based on the hydrophilic organic liquid, more preferably no more than 50% by mass, and depends somewhat on the species of the hydrophilic organic liquid.

The polymerization initiators may be conventional radical initiators soluble in the employed solvent. Examples thereof include azo-based polymerization initiators such as 2,2'-azobisisobutyronitrile, and 2,2'-azobis(2,4-dimethylvaleronitrile); and peroxide-based initiators such as lauryl peroxide, benzoyl peroxide, tert-butyl peroctoate, and potassium persulfate; the polymerization initiators may be combined with sodium thiosulfate, amines and the like.

The content of the polymerization initiator is preferably 0.1 part by mass to 10 parts by mass based on 100 parts by mass of the vinyl monomer. The polymerization is carried out in a way that the polymer dispersant is completely dissolved in the hydrophilic organic liquid, then one or more of vinyl monomer, polymerization initiator and the like are added to the solution, followed by heating at the temperature corresponding to the dispersion rate of the polymerization initiator while stirring the reaction mixture in a rate to cause an uniform flow within the reaction vessel. The temperature at initial polymerization significantly affects the particle size, therefore, it is preferred that the temperature is raised to the polymerization temperature after the addition of monomers and the polymerization initiator is conducted as a solution with a small amount of solvent.

In the polymerization process, it is preferred that the oxygen of air in the reaction vessel is sufficiently purged with inert gas such as nitrogen and argon. In cased where the oxygen purge is insufficient, finer particles tend to easily generate.

Preferably, the polymerization is carried out for 5 to 40 hours in order to ensure higher polymerization degrees. The polymerization may be ceased at the stage of a desirable particle size and its distribution; or the polymerization rate may be enhanced by successive additions of polymerization initiators or reaction under higher pressures.

The polymerization may be carried out in coexistence with compounds having higher chain transfer coefficients in order to adjust the average molecular weight of resin fine particles. Examples of the compounds having higher chain transfer coefficients include lower molecular weight compounds having a mercapto group; carbon tetrachloride, and carbon tetrabromide.

The mass average molecular weight of the resin fine particles may be properly selected depending on the application; preferably, the mass average molecular weight is no less than 1,000, more preferably 2,000 to 10,000,000, still more preferably 3,000 to 1,000,000. In cases where the mass average molecular weight is less than 1,000, the hot-offset resistance may be deteriorated.

The glass transition temperature (Tg) of the resin fine particles may be properly selected depending on the application; preferably, Tg is 30° C. to 70° C., more preferably 40° C. to 65° C. In cases where the Tg is below 30° C., the toner may degrade the storage stability under higher temperatures, and when the Tg is above 70° C., the fixing property may be insufficient at lower temperatures.

The volume average particle diameter of the resin fine particles is preferably 3 μm to 12 μm, more preferably 4 μm to 8 μm.

Step of Forming Coating Layer

In the step of forming a coating layer, a toner functional substance is attached or coated on the surface of toner base particles to thereby form a coating layer using at least one of supercritical fluids and sub-supercritical fluids.

The term "toner functional substance" means substances to realize developing properties of electric photography; examples thereof include colorants, charge control agents, release agents and coating resins, and also as required, flow improvers, cleaning improvers and the like.

The step of forming a coating layer may be, for example, (i) a step of forming a colorant-coating layer, in which the toner functional substance is a colorant, and the colorant is coated in the layer, (ii) a step of forming a resin-coating layer, in which the toner functional substance is a resin, and the resin is coated in the layer, (iii) a step of forming a charge control agent-coating layer, in which the toner functional substance is a charge control agent, and the charge control agent is coated in the layer, and (iv) a step of forming a release agent-coating layer, in which the toner functional substance is a release agent, and the release agent is coated in the layer. These steps may be properly combined in optional order, thereby various coating layers may be formed on the surface of toner base particles. These steps will be explained in detail below.

Supercritical Fluid and Sub-Supercritical Fluid

The supercritical fluid means those fluids that have intermediate properties between gas and liquid, such as higher mass transfer, larger heat transfer and lower viscosities, and also can be significantly and successively changed in terms of their density, dielectric constant, solubility parameter and free volume by controlling temperature or pressure. In addition, the supercritical fluids exhibit lower surface tension compared to organic solvents, therefore can conform to small surface irregularities and wet the surface.

The supercritical fluid may be properly selected depending on the application as long as capable of existing as a noncondensable high-density fluid at temperature-pressure regions above a critical point where the gas and liquid can coexist, i.e. the fluid may be far from condensation and be a liquid at above the critical temperature and also the critical pressure. Preferably, the critical temperature and the critical pressure are as lower as possible. The sub-supercritical fluid may be properly selected depending on the application as long as capable of existing as a high-pressure liquid at temperature-pressure regions near the critical point.

Preferable examples of the supercritical fluids and sub-supercritical fluids include carbon monoxide, carbon dioxide, ammonia, nitrogen, water, methanol, ethanol, ethane, propane, 2,3-dimethylbutane, benzene, chlorotrifluoromethane and dimethylether. Among these, carbon dioxide is preferable in particular since the supercritical condition of the critical pressure at 7.3 MPa and the critical temperature at 31° C. is relatively easily created, the handling is convenient due to its incombustibility and inactivity, and the surface of the toner base particles can be made hydrophobic by virtue of its nonaqueous nature.

The supercritical fluids and sub-supercritical fluids may be used alone as one component or in combination of two or more as a mixture.

The critical temperature and the critical pressure of supercritical fluids may be properly selected depending on the application; the critical temperature is preferably −273° C. to 300° C., more preferably 0° C. to 200° C.; and the critical pressure is preferably 5 MPa to 100 MPa, more preferably 10 MPa to 50 MPa.

In the present invention, the coating layer may be formed for thin-film formation, encapsulation or film-thickness control, alternatively for coloring of resin fine particles by pressure-injection by way of making advantageously use of natures of the supercritical fluids or sub-supercritical fluids.

Preferably, at least one of supercritical fluids and sub-supercritical fluids can dissolve the toner functional substances without dissolving the toner base particles.

Preferably, the coating layer is formed by way of depositing a toner functional substance dissolving in one of supercritical fluids and sub-supercritical fluids.

The coating layer can be formed by precipitating or depositing a uniform coating layer on the surface of toner fine particles i.e. on the surface of resin fine particles through controlling the solubility of the toner functional substance as a solute in the supercritical fluids by adjusting the temperature and pressure. Specifically, a toner functional substance is dissolved or finely dispersed under a condition where toner base particles or resin fine particles being far from dissolution, then the mixture is subjected under a reduced pressure, thereby the toner functional substance is deposited or fixed on the surface of resin fine particles to form a uniform coating layer.

In addition, the high permeability or diffusivity of supercritical fluids can be utilized for impregnating or pressure-injecting colorants to fix within inner portions of toner base particles or resin fine particles.

For example, coloring methods by use of the supercritical fluids can afford coloration and toughness with higher efficiencies and shorter periods, which being impossible by toner producing methods based on conventional coloring processes. In contrary to this, coloring of toner in later steps can color solely the surface and its vicinity and provide insufficient toughness, and also affords various problems such as inefficiency, longer processing periods, waste-liquid products, higher costs, environmental load and lower color-degradation resistance.

The supercritical fluids may also allow easy separation from intended products and may be recycled and reused, thus innovative production methods may be realized that impose lower environmental load with no use of solvents.

Other fluids may be used together with the supercritical fluids and sub-supercritical fluids. The other fluids are preferably those controllable the solubility of component materials of the toner. Specifically, preferable examples thereof include methane, ethane, propane and ethylene.

Entrainers or azeotropic agents may be involved in addition to the supercritical fluids and sub-supercritical fluids. The addition of entrainers may allow to easily form the coating layers. The entrainers may be properly selected depending on the application; preferably, the entrainers are polar organic solvents. Examples of the polar organic solvents include methanol, ethanol, propanol, butanol, hexane, toluene, ethylacetate, chloroform, dichloromethane, ammonia, melamine, urea and ethylene glycol. Among these, chloroform is preferable in view of higher resin solubility. The addition of chloroform may enhance the effect to deposit the toner functional substances onto the surface of toner base particles. The supercritical fluids and sub-supercritical fluids are preferably selected from those capable of dissolving the materials of various coating layers without dissolving the resin fine particles. Specifically, lower alcohol solvents are preferable that exhibit poor solubility against toner base particles under room temperature and normal pressure.

Preferably, the entrainer is selected from those insoluble or somewhat swellable for the toner base particles or resin fine particles; specifically, it is preferred that the difference of solubility parameters (SP value) is preferably no less than 1.0 between the entrainer and the resin fine particles, more preferably no less than 2.0. With respect to styrene-acrylic resins, for example, those having higher SP values such as alcohols like methanol, ethanol and n-propanol or those having lower SP values such as n-hexane and n-heptane are preferably employed. It is apparent that larger difference of SP values may deteriorate the wettability to toner base particles or resin fine particles and the dispersion of toner base particles or resin fine particles is likely to inappropriate, therefore, the optimum difference of the SP value is preferably 2 to 5.

The content of the entrainer is preferably 0.1% by mass to 10% by mass base on the mixture fluid of the entrainer and at least one of the supercritical fluids and sub-supercritical fluids. When the content is less than 0.1% by mass, the effect of the entrainer is likely to be difficult to obtain, and when over 10% by mass, the significant nature of the entrainer as liquids may make difficult to generate the condition of supercritical or sub-supercritical.

In the step of forming a colorant-coating layer of aforementioned step of forming a coating layer, the toner functional substance is utilized as a colorant, then at least one of the supercritical fluids and sub-supercritical fluids, toner base particles, and the colorant are contacted to thereby form the colorant-coating layer.

In this step, it is more preferred that the colorant dissolved by at least one of the supercritical fluids and sub-supercritical fluids is made contact with the toner base particles to thereby color the toner base particles.

The colorant may be selected from conventional dyes and pigments depending on the application; examples thereof include carbon black, nigrosine dyes, iron black, Naphthol Yellow S, Hansa Yellow (10G, 5G, G), cadmium yellow, yellow iron oxide, yellow ocher, chrome yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, anthracene yellow BGL, isoindolinone yellow, colcothar, red lead oxide, lead red, cadmium red, cadmium mercury red, antimony red, Permanent Red 4R, Para Red, Fire Red, parachlororthonitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc white, and lithopone. These may be used singly or in combination.

Dyes may be preferably utilized for the colorant in particular due to their solubility into at least one of the supercritical fluids and sub-supercritical fluids. The dyes may be properly selected depending on the application; examples thereof include C.I.SOLVENT YELLOW (6, 9, 17, 31, 35, 100, 102, 103, 105), C.I.SOLVENT ORANGE (2, 7, 13, 14, 66), C.I.SOLVENT RED (5, 16, 17, 18, 19, 22, 23, 143, 145, 146, 149, 150, 151, 157, 158), C.I.SOLVENT VIOLET (31, 32, 33, 37), C.I.SOLVENT BLUE (22, 63, 78, 83-86, 191, 194, 195, 104), C.I.SOLVENT GREEN (24, 25), and C.I.SOLVENT BROWN (3, 9).

In addition, examples of commercially available dyes include Aizen SOT dyes such as Yellow-1, 3, 4, Orange-1, 2, 3, Scarlet-1, Red-1, 2, 3, Brown-2, Blue-1, 2, Violet-1, Green-1, 2, 3, and Black-1, 4, 6, 8 (produced by Hodogaya Chemical Co., Ltd.); Sudan dyes such as Yellow-146, 150, Orange-220, Red-290, 380, 460, and Blue-670 (produced by BASF Japan, Ltd.); Diaresin Yellow-3G, F, H2G, HG, HC, HL, Diaresin Orange-HS, G, Diaresin Red-GG, S, HS, A, K, H5B, Diaresin Violet-D, Diaresin Blue-J, G, N, K, P, H3G, 4G, Diaresin Green-C, and Diaresin Brown-A (produced by Mitsubishi Chemical Industries. Ltd.); Oil Color Yellow-3G, GG-S, #105, Oil Color Orange-PS, PR, #201, Oil Color Scarlet-#308, Oil Color Red-5B, Oil Color Brown-GR, #416, Oil Color Green-BG, #502, Oil Color Blue-BOS, IIN, and Oil Color Black-HBB, #803, EB EX (produced by Orient Chemical Industries, Ltd.); Sumiplast Blue-GP, OR, Sumiplast Red-FB, 3B, and Sumiplast Yellow FL7G, GC (produced by Sumitomo Chemical Co., Ltd.); and Kayaron Polyester Black EX-SF300, Kayaset Red-B, and Kayaset Blue-A-2R (produced by Nihon Kayaku Co., Ltd).

The dyes utilized for the coloring may be any dyes as long as the ratio D1/D2 being no more than 0.5, in which D1 represents the solubility in the entrainer of an organic solvent, D2 represents the solubility in the organic solvent capable of dissolving the resin fine particles. Preferably, disperse dyes, oil-soluble dyes and vat dyes are utilized from the viewpoint for maintaining the powder resistance of the colored toner at higher levels, and the oil-soluble dyes are preferable in particular. Plural dyes may be utilized depending on the desirable coloring. When the resistance is lower, the transfer rate may possibly be lowered.

The coloring method is carried out by, for example, disposing toner base particles of resin fine particles and a dye into a pressure container, and treating by use of the supercritical fluid apparatus, alternatively, a mixture dispersing or dissolving a dye into an organic solvent is used as an entrainer and subjected to the treatment.

The content of the colorant may be properly selected depending on the color degree; preferably, the content is 1 part by mass to 50 parts by mass based on 100 parts by mass of the toner base particles, more preferably 2 parts by mass to 30 parts by mass.

In the step of forming a resin-coating layer of aforementioned step of forming a coating layer, the toner functional substance is utilized as a resin, then at least one of the supercritical fluids and sub-supercritical fluids, toner base particles, and the resin are contacted to thereby form the resin-coating layer.

The coating resin for forming the resin-coating layer may be properly selected depending on the application; examples thereof include polymethylmethacrylate resins, polystyrene resins, poly-α-methylstyrene resins, styrene-chlorostyrene copolymers, styrene-propylene copolymers, styrene-butadiene copolymers, styrene-vinyl chloride copolymers, styrene-vinylacetate copolymers, styrene-maleic acid copolymers, styrene acrylic acid ester copolymers, styrene-methacrylic acid ester copolymers, styrene-α-methylchloroacrylate copolymers; styrene resins such as styrene-acrylonitrile-acrylate copolymers; polyester resins, polyol resins, epoxy resins, vinylchloride resins, rosin-modified maleic resins, phenol resin, polyethylene resins, polypropylene resins, polyurethane resins, ketone resins, ethylene-ethylacrylate copolymers, xylene resins and polyvinyl butylate resins. These may be used alone or in combination of two or more.

The amount of the coating may be properly selected depending on the application; preferably, the amount is 1 part by mass to 300 parts by mass based on 100 parts by mass of the toner base particles, more preferably 10 parts by mass to 200 parts by mass.

In the step of forming a charge control agent-coating layer of aforementioned step of forming a coating layer, the toner functional substance is utilized as a charge control agent, then at least one of the supercritical fluids and sub-supercritical fluids, toner base particles, and the charge control agent are contacted to thereby form the charge control agent-coating layer.

The charge controlling agent is not particularly limited and can be appropriately selected from those known in the art. In cases there a colored material is used for the charge controlling agent, the toner may show different tones of color and, therefore, colorless materials or materials close to white are preferably used. Examples of charge controlling agents include nigrosine dyes, triphenylmethane dyes, chrome-containing metal complex dyes, molybdic acid chelate pigments, rhodamine dyes, alkoxy amines, quaternary ammonium salts (including fluoride-modified quaternary ammonium salts), alkylamides, phosphous or compounds thereof, tungsten or compounds thereof, fluorine-containing surfactants, metal salts of salicylic acid, and metal salts of salicylic acid derivatives. In addition, the metals can be appropriately selected depending on the intended purpose. Examples of the metals include aluminum, zinc, titanium, strontium, boron, silicon, nickel, iron, chrome, and zirconium.

The charge controlling agent may be selected from conventional ones; examples thereof include Bontron P-51 of a quaternary ammonium salt, Bontron E-82 of an oxynaphthoic acid metal complex, Bontron E-84 of a salicylic acid metal complex, and Bontron E-89 of a phenol condensate (produced by Orient Chemical Industries, Ltd.); TP-302 and TP-415, both are a quaternary ammonium salt molybdenum metal complex (produced by Hodogaya Chemical Co.); Copy Charge PSY VP2038, and Copy Charge NEG VP2036 and Copy Charge NX VP434, those are quaternary ammonium salts, Copy Blue PR of a triphenylmethane derivative (produced by Hoechst Ltd.); LRA-901, and LR-147 of a boron metal complex (produced by Japan Carlit Co., Ltd.); quinacridones; azo pigments; and high-molecular mass compounds having sulfonic acid, carboxylic acid and a quaternary ammonium salt.

The amount of the charge controlling agent may be properly selected depending on the application; preferably the amount is 0.5 part by mass to 5 parts by mass based on 100 parts by mass of the toner base particles, more preferably 1 part by mass to 3 parts by mass. When the amount is less than 0.5 parts by mass, it may result in poor toner charging ability, and when more than 5 parts by mass, the charging properties of toner becomes exceedingly enhanced, resulting in reducing the effect of the charge controlling agent primarily used, and an electrostatic suction force that presses toner against developing rollers increases. Thus, it may cause reduction in the flowability of the developer and in image density.

In the step of forming a release agent-coating layer of aforementioned step of forming a coating layer, the toner functional substance is utilized as a release agent, then at least one of the supercritical fluids and sub-supercritical fluids, toner base particles, and the release agent are contacted to thereby form the release agent-coating layer.

The releasing agent may be properly selected from conventional ones depending on the intended purpose. Waxes are suitable; example thereof include lower molecular mass polyolefin waxes, synthesized hydrocarbon waxes, natural waxes, petroleum waxes, higher fatty acids and metal salts thereof, higher fatty acid amides, and modifications of the above-listed waxes. These may be used singly or in combination.

Examples of the low-molecular mass polyolefin waxes include lower molecular weight polyethylene waxes and lower molecular weight polypropylene waxes. Examples of the synthesized hydrocarbon waxes include Fischer-Tropsh wax. Examples of the natural wax include bee wax, Carnauba wax, Candelilla wax, rice wax, and Montan wax. Examples of the petroleum wax include paraffin wax, and microcrystalline wax. Examples of the high fatty acids include stearic acid, palmitic acid, and myristic acid.

The melting point of the releasing agent may be properly selected depending on the purpose; preferably, the temperature is 40° C. to 160° C., more preferably 50° C. to 120° C., most preferably 60° C. to 90° C. When the melting point is lower than 40° C., the wax may have negative effects on thermal stability, and when the melting point is higher than 160° C., it is likely that cold offset may occur during a low-temperature fixing process, and a paper sheet is likely to wind itself around the fixing device.

The amount of the release agent may be properly selected depending on the application; preferably, the amount is 1 part by mass to 20 parts by mass based on 100 parts by mass of the toner base particles, more preferably 3 parts by mass to 15 parts by mass.

The flowability improver is an agent that improves hydrophobic properties of toner through surface treatment and is capable of preventing reduction of the flowability and charging ability under higher humidities. Examples thereof include silane coupling agents, sililating agents, silane coupling agents bearing a fluorinated alkyl group, organotitanate coupling agents, aluminum-based coupling agents, silicone oils, and modified silicone oils.

The cleaning improver is added to the toner to remove a developer remaining on a photoconductor and on a primary transferring member after a transferring step. Examples thereof include fatty acid metal salts such as zinc stearate, calcium stearate, stearic acid, and resin particles prepared by soap-free emulsion polymerization such as polymethylmethacrylate particles and polystyrene particles. Among these, polymer particles with a relatively narrow particle size distribution are preferable, and polymer particles with a volume-average particle diameter of 0.01 μm to 1 μm are more preferable.

Preferably, the coating layer is formed onto a partial or entire surface of the toner base particles. In this case, the coating layer may be selectively formed onto desirable sites on the surface of the toner base particles.

The method for forming the coating layer may be properly selected depending on the application as long as at least one of the supercritical fluids and sub-supercritical fluids is caused to contact with the toner base particles.

The apparatus for forming the coating layer may be properly selected depending on the application; the apparatus is appropriately exemplified by those equipped with a pressure vessel, which being adapted for treating to form the coating layer on the toner base particles, and a pressure pump for supplying the supercritical fluid. In the treating method by use of the apparatus, the toner base particles are loaded into the pressure vessel, the supercritical fluid is fed into the pressure vessel by use of a pressure pump thereby to make the supercritical fluid contact with the toner base particles, consequently a material for forming a coating layer such as colorants, release agents, resins and charge control agents is deposited onto the surface of the toner base particles, then the supercritical fluid is discharged. When the supercritical fluid is subsequently turned into room temperature and normal pressure, the supercritical fluid comes to a gas; accordingly, the method may be of less environmental load since solvent-removal is unnecessary and no waste water generates conventionally required for rinsing the surface of toner base particles.

The temperature, at which the coating layer being formed, may be properly selected depending on the application as long as above the critical temperature of the supercritical fluid or sub-supercritical fluid; the higher limit of the critical temperature is preferably below the melting point of the substance of the toner base particles, more preferably is within the temperatures at which the toner base particles are far from coagulation due to adhesion of the particles. The lower limit of the critical temperature is preferably within the temperatures at which the other fluid capable of adding to the supercritical fluid can exist as a gas.

Specifically, the temperature at which the coating layer being formed is preferably 0° C. to 100° C., more preferably 20° C. to 80° C. When the temperature is above 100° C., the toner base particles may possibly dissolve.

The pressure, at which the coating layer being formed, may be properly selected depending the application as long as higher than the critical pressure of the supercritical fluid or sub-supercritical fluid; preferably, the pressure is 1 MPa to 60 MPa.

Figure 2:
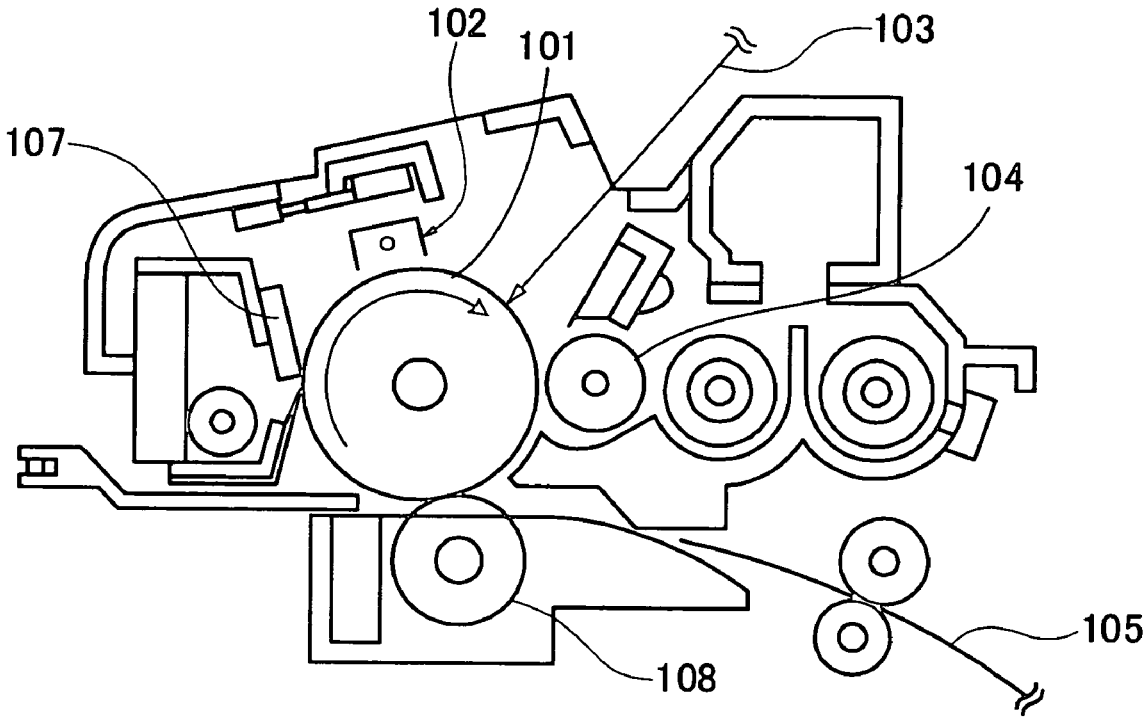
FIG. 2 is a schematic view that explains exemplarily a process cartridge according to the present invention.

The method for forming a resin-coating layer on the surface of toner base particles will be explained that utilizes an apparatus for forming a coating layer. The apparatus for forming a coating layer shown in FIG. 1 is equipped with reaction vessel 9 having a volume of 1,000 $cm^3$. In FIG. 2, there exist entrainer tank 1, pressure pump 4, temperature sensor 6, spray nozzle 113, and pressure sensor 114.

Carbon dioxide ($CO_2$) is utilized for the gas to form the supercritical fluid. An olefin polymer having a cyclic structure is poured into reaction vessel 9 for the material of coating layer, and resin fine particles are added as toner base particles.

Next, carbon oxide gas is supplied from a gas container 1, pressurized by a pressure pump 3, and introduced into a reaction vessel 9 via valve 7. At this time, valve 5 is closed and therefore the carbon oxide gas is not introduced into discharge vessel 112, and decompression valve 8 for exhaust and discharge is kept closed. Thus, introduction of high-pressure carbon dioxide increases the pressure inside the reaction vessel 9. In addition, the temperature inside the reaction vessel 9 is adjusted to 320 K by means of heater 117.

A supercritical state is established in the reaction vessel 9 at the time when the inner pressure has reached 7.3 MPa. Valves 5 and 7 are adjusted to set the inner pressure of the reaction vessel 9 to 20 MPa, causing the composition having at least polymerizable monomers and fluorine-containing surfactants in the reaction vessel 9 to dissolve in supercritical carbon dioxide. In this state, the valves 5 and 7 are closed, the composition is allowed to remain dissolved in the supercritical carbon dioxide for 120 minutes, and the supercritical fluid is distributed throughout the reaction vessel 9. Thereafter, the valve 8 is opened to adjust the inner pressure of the reaction vessel 9 to 10 MPa, and this state is retained for 60 minutes. Carbon dioxide gas is again introduced into the reaction vessel 9 from the high-pressure pump side. Introduction of carbon dioxide gas is continued while maintaining the inner pressure of the reaction vessel to 10 MPa. At this point, supercritical carbon dioxide and the composition having at least polymerizable monomers and fluorine-containing surfactants dissolved therein are recovered by means of a recover mechanism (not shown), and are separated into discrete ingredients (carbon dioxide and the composition having at least polymerizable monomers and fluorine-containing surfactants) by means of a separator (not shown), each of which is recycled for reuse.

Continuous introduction of supercritical carbon dioxide discharges entirely the olefin polymer having a cyclic structure dissolved within the reaction vessel 9 outside thereof, thus there remain within the reaction vessel 9 exclusively the resin fine particles with the coating layer of deposited olefin polymer having a cyclic structure and the supercritical fluid of carbon dioxide. Thereafter, the valve 8 is opened to allow the supercritical carbon dioxide fluid to turn into gas thereby to produce dry resin fine particles with the coating layer of olefin polymer having a cyclic structure.

In accordance with the processes described above, the resin-coating layer may be formed on the surface of toner base particles by use at least one of the supercritical fluids and sub-supercritical fluids; consequently, the inventive toner may be provided with superior charging capabilities and surface properties.

The shape, size, and several features of the toner may be properly selected depending on the application; preferably, the toner has image density, average circularity, volume-average particle diameter, ratio of volume-average particle diameter to number-average particle diameter (volume-average particle diameter/number-average particle diameter) etc.

The image density is preferably 1.90 or more, more preferably 2.00 or more, most preferably 2.10 or more, as determined using a spectrometer (X-Rite 938 Spectropensitometer).

When the image density is less than 1.90, it results in lower image densities and thus high quality images may not be obtained.

The image density can be measured as follow: a solid image with a deposited developer amount of 1.00±0.05 $mg/cm^2$ is formed on a copy sheet (Type 6000<70W>, Ricoh Company, Ltd.) using Imagio Neo 450 (Ricoh Company, Ltd.) having a fixing roller whose surface temperature is set to 160±2° C. Subsequently, the image densities of 6 randomly chosen points are measured using a spectrometer (X-Rite 938 Spectropensitometer), followed by calculation of the mean of the measured values.

The average circularity is a measure obtained by dividing the circumference of a circle that has the same area as an actual projected area of a toner particle by the circumference of that toner particle, and is preferably 0.900 to 0.980, more preferably 0.950 to 0.975. It is preferable that the proportion of particles having the average circularity of less than 0.940 be no more than 15% of the total particles.

When the average circularity is less than 0.900, it may result in poor transfer properties, and dust-free high quality images may not be obtained. In cases where the average circularity is greater than 0.980, it becomes likely that cleaning failures occur on the photoconductor and transfer belt in an image-forming system equipped with a cleaning blade, causing smears on images. For example, in a case of formation of an image that occupies a large area of a sheet (e.g., photographic images), background smears may occur, because, when paper feed failure or the like occurs, toner particles that have been used to develop the image remains unremoved and accumulates on the photoconductor, or, in that case, a charging roller which provides charges to the photoconductor becomes soiled by residual toner particles and thus its original charging ability may be impaired.

The average circularity may be measured, for example, by an optical detection zone method in which a suspension containing the toner is passed through an image-detection zone disposed on a plate, the particle images of the toner are optically detected by means of a CCD camera, and the obtained particle images are analyzed. For example, flow-type particle image analyzer FPIA-2100 (by Sysmex Corp.) is available.

The volume average particle diameter (Dv) of the toner is preferably 3 μm to 8 μm. In cases where the volume average particle diameter is less than 3 μm, the toner of two-component developer is liable to fuse onto carrier surfaces as a result of stirring in the developing unit for a long period, and a one-component developer is liable to cause a filming to a developing roller or fusion to a member such as a blade for reducing a thickness of a toner layer formed onto a developing roller. In cases where the volume average particle diameter is more than 8 μm, an image of high resolution and high quality is rarely obtained, and the average toner particle diameter is liable to fluctuate when a toner is repeatedly added to the developer to compensate the consumed toner.

The ratio (Dv/Dn) of the volume average particle diameter (Dv) to the number average particle diameter (Dn) is preferably 1.00 to 1.25, more preferably 1.10 to 1.25.

In cases where the ratio is less than 1.00, the toner of a two-component developer is liable to fuse onto carrier surfaces due to stirring in a developing unit for a long-term, thereby degrading a charging ability of the carrier or cleaning properties, and a one-component developer is liable to cause a filming to a developing roller or fusion to a member such as a blade for reducing a thickness of a toner layer formed onto a developing roller. In cases where the ratio is more than 1.25, an image of high resolution and high quality is rarely obtained, and the average toner particle diameter is liable to fluctuate when a toner is repeatedly added to the developer to compensate the consumed toner.

The volume-average particle diameter and the ratio of volume-average particle diameter to number-average particle diameter may be determined using, for example, Coulter Counter TA-II, a particle size analyzer manufactured by Coulter Electronics Inc.

In accordance with the toner producing method according to the present invention, the coating layer is formed on the surface of toner base particles by use at least one of the supercritical fluids and sub-supercritical fluids in the step of forming a coating layer, thereby the coating layer formed from the material forming the coating layer such as colorants, release agents, resins and charge control agents. As a result, the toners according to the present invention may be efficiently with superior properties in terms of coloring, releasing, charging and surface properties without significant environmental loads.

Developer

The developer according to the present invention contains the toner of the present invention and appropriately selected additional ingredients such as a carrier. The developer may be either of one-component or two-component; when it is applied to high-speed printers that support increasing information processing rates of recent years, two-component developers are preferable in view of achieving excellent shelf life.

In the case of one-component developers containing the toners of the present invention, the variations in the toner particle diameter are minimized even after consumption or addition of toner, and toner filming to a developing roller and toner adhesion to members such as blade to reduce layer thickness of the toner are prevented. Thus, it is possible to provide excellent and stable developing properties and images even after a long time usage of the developing unit, i.e. after long time agitation of developer. Meanwhile, in the case of two-component developers containing the toners of the present invention, even after many cycles of consumption and addition of toner, the variations in the toner particle diameter are minimized and, even after a long time agitation of the developer in the developing unit, excellent and stable developing properties may be obtained.

Carrier

The carrier may be properly selected depending on the application, preferably, is one having a core material and a resin layer coating the core material.

The material for the core may be properly selected from conventional ones; preferable examples thereof include materials based on manganese-strontium (Mn—Sr) of 50 emu/g to 90 emu/g and materials based on manganese-magnesium (Mn—Mg) are preferable. From the standpoint of securing image density, high magnetizing materials such as iron powder (100 emu/g or more) and magnetite (75 emu/g to 120 emu/g) are preferable. In addition, weak magnetizing materials such as copper-zinc (Cu—Zn)-based materials (30 emu/g to 80 emu/g) are preferable from the standpoint for achieving higher-grade images by reducing the contact pressure against the photoconductor having standing toner particles. These materials may be used singly or in combination.

The particle diameter of the core material, in terms of volume-average particle diameter, is preferably 10 μm to 150 μm, more preferably 40 μm to 100 μm.

In cases where the average particle diameter (volume-average particle diameter ($D_{50}$)) is less than 10 μm, fine particles make up a large proportion of the carrier particle distribution, causing carrier scattering due to reduced magnetization per particle in some cases, on the other hand, and in cases where it exceeds 150 μm, the specific surface area of the particle decreases, causing toner scatterings and reducing the reproducibility of images, particularly the reproducibility of solid images in full-color images due to many solid images in full-color images.

Materials for the resin layer may be properly selected from conventional ones depending on the intended purpose. Examples thereof include amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride and acrylic monomers, copolymers of vinylidene fluoride and vinyl fluoride, fluoroterpolymers such as terpolymers of tetrafluoroethylene, vinylidene fluoride and non-fluoride monomers, and silicone resins. These resins may be used singly or in combination.

Examples of the amino resins include urea-formaldehyde resins, melamine resins, benzoguanamine resins, urea resins, polyamide resins, and epoxy resins; examples of the polyvinyl resins include acrylic resins, polymethyl methacrylate resins, polyacrylonitrile resins, polyvinyl acetate resins, polyvinyl alcohol resins, and polyvinyl butyral resins; examples of the polystyrene resins include polystyrene resins, and styrene-acryl copolymer resins; examples of the halogenated olefin resins include polyvinyl chloride; examples of the polyester resins include polyethylene terephthalate resins, and polybutylene terephthalate resins.

The resin layer may contain such material as conductive powder depending on the application. Examples of the conductive powder include metal powder, carbon black, titanium oxide, tin oxide and zinc oxide. These conductive powders preferably have an average particle diameter of 1 μm or less. In cases where the average particle diameter is greater than 1 μm, it may be difficult to control electrical resistance.

The resin layer may be formed by dissolving the silicone resin or the like into a solvent to prepare a coating solution, uniformly coating the surface of the core material with the coating solution by a known coating process, and drying and baking the core material. Examples of the coating process include immersing processes, spray processes, and brush painting processes.

The solvent may be properly selected depending on the application; examples thereof include toluene, xylene, methyl ethyl ketone, methyl isobutyl ketone, cellosolve, and butylacetate.

The baking process may be an externally heating process or an internally heating process, and may be selected from, for example, those processes using a fixed type electric furnace, a fluid type electric furnace, a rotary type electric furnace or a burner furnace, and a process using microwave.

The content of the resin layer in the carrier is preferably 0.01% by mass to 5.0% by mass. In cases where the content is less than 0.01% by mass, it may be difficult to form a uniform resin layer on the surface of the core material, on the other hand, in cases where the content exceeds 5.0% by mass, the resin layer becomes so thick that carrier particles may associate together, thus possibly resulting in failure to obtain uniform carrier particles.

When the developer is a two-component developer, the content of the carrier in the two-component developer may be properly selected depending on the application; for example, the content is preferably 90% by mass to 98% by mass, more preferably 93% by mass to 97% by mass.

Since the developer contains the toner of the present invention, it offers excellent charging properties upon formation of an image and can realize stable formation of high-quality images.

The developer can be suitably applied to a variety of known electrophotographic image forming processes including a magnetic one-component developing process, non-magnetic one-component developing process, and two-component developing process, particularly to a toner container, process cartridge, image forming apparatus and image forming method of the present invention described below.

Toner-Containing Container

The toner-containing container according to the present invention is a container supplied with the toner of the present invention or the developer containing the toner of the present invention.

The toner container may be properly selected from conventional containers, for example, a toner container having a container main body and a cap is a suitable example.

The size, shape, structure, material and several features of the container main body may be properly selected depending on the purpose. For example, the container main body may preferably have a cylindrical shape, most preferably a cylindrical shape in which spiral grooves are formed on its inner surface that allow toner in the container to shift to the outlet along with rotation of the main body, and in which all or part of the spiral grooves have a bellow function.

Materials for the container main body may be properly selected depending on the purpose, preferably are those capable of providing accurate dimensions upon the fabrication. Examples thereof include resins, in particular, polyester resins, polyethylene resins, polypropylene resins, polystyrene resins, polyvinyl chloride resins, polyacrylic acid resins, polycarbonate resins, ABS resins, and polyacetal resins.

The toner-containing container according to the present invention may provide conveniences in storage, transport, and handling. The toner-containing container can be suitably used to supply toners by detachably attaching to process cartridges, image forming apparatuses according to the present invention.

Process Cartridge

The process cartridge used in the present invention contains a latent electrostatic image bearing member configured to bear a latent electrostatic image, and a developing unit configured to develop the latent electrostatic image formed on the latent electrostatic image bearing member using a toner to thereby form a visible image, and further contains additional units as required.

The developing unit contains a developer storing container for storing the toner of the present invention or the developer, and a developer carrier for carrying and transferring the toner or developer stored in the developer container, and may further contains a layer-thickness control member for controlling the thickness of the layer of toner to be carried.

The process cartridge contains, for example, as shown in FIG. 2, latent electrostatic image bearing member 101, charging unit 102, developing unit 104, transferring unit 108, and cleaning unit 107 and, if necessary, further contains additional units. In FIG. 2, 103 denotes an exposure light by means of an exposing unit, and 105 denotes a recording medium.

Next, an image forming process by means of the process cartridge shown in FIG. 2 will be described. The latent electrostatic image bearing member 101 rotates in the arrow direction, charged by means of the charging unit 102 and is exposed with the exposure light 103 by means of an exposing unit (not shown), whereby a latent electrostatic image corresponding to the exposed image is formed thereon. This electrostatic image is developed by means of the developing unit 104, and the resultant visible image is transferred to the recording medium 105 by means of the transferring unit 108. The recording medium 105 is then printed out. Subsequently, after transferring the image, the surface of the latent electrostatic image bearing member 101 is cleaned by means of the cleaning unit 107, and charges are removed by means of a charge-eliminating unit (not shown). This whole process is continuously repeated.

The photoconductor 101 may be substantially the same as that of the image forming apparatus described later. The charging unit 102 may be any charging members. The exposing unit 103 may be selected from optical sources capable of writing with higher resolution. The process cartridge according to the present invention can be detachably mounted on a variety of electrophotographic image forming apparatuses and preferably detachably mounted on the electrophotographic image forming apparatuses of the present invention, which is described later.

Image Forming Method and Image Forming Apparatus

The image forming method of the present invention contains at least a latent electrostatic image forming step, a developing step, a transferring step and a fixing step, and further contains additional steps such as a charge eliminating step, a cleaning step, a recycling step and a controlling step, which are optionally selected as needed.

The image forming apparatus used in the present invention contains an latent electrostatic image bearing member, a latent electrostatic image forming unit, a developing unit, a transferring unit and a fixing unit, and further contains additional units such as a charge eliminating unit, a cleaning unit, a recycling unit and a controlling unit, which are optionally selected as needed.

In the latent electrostatic image forming step, latent electrostatic images are formed on a latent electrostatic image bearing member.

The material, shape, size, structure, and several features of the latent electrostatic image bearing member (sometimes referred to as "photoconductor") are not particularly limited, and may be selected from those known in the art. Preferably, the latent electrostatic image bearing member has a drum shape, the materials thereof are inorganic photoconductive materials such as amorphous silicon and selenium, and organic photoconductive materials such as polysilane and phthalopolymethine. Among these, amorphous silicon is preferable in particular from the viewpoint of longer lifetime.

The formation of the latent electrostatic image is achieved by, for example, exposing the latent electrostatic image bearing member imagewisely after equally charging its entire surface. This step is performed by means of the latent electrostatic image forming unit. The latent electrostatic image forming unit contains a charging device configured to equally charge the surface of the latent electrostatic image bearing member, and an exposing device configured to expose imagewisely the surface of the latent electrostatic image bearing member.

The charging step may be carried out by, for example, applying a voltage to the surface of the latent electrostatic image bearing member by means of a charging device.

The charging device may be properly selected depending on the application; examples thereof include known contact-charging devices equipped with a conductive or semiconductive roller, blush, film or rubber blade, and known non-contact-charging devices utilizing corona discharge such as corotron or scorotoron.

The exposing step is achieved by, for example, exposing the surface of the photoconductor imagewisely by means of an exposing unit.

The exposing device is not particularly limited as long as it is capable of performing imagewise exposure on the surface of the charged latent electrostatic image bearing member by means of the charging device, and may be appropriately selected depending on the intended use. Examples thereof include various exposing devices, such as optical copy devices, rod-lens-eye devices, optical laser devices, and optical liquid crystal shatter devices.

In the present invention, a backlight system may be employed for exposure, where imagewise exposure is performed from the back side of the latent electrostatic image bearing member.

Developing Step and Developing Unit

In the developing step, the latent electrostatic image is developed using the toner according to the present invention or developer to form a visible image.

The formation of the visible image can be achieved, for example, by developing the latent electrostatic image using the toner of the present invention or the developer, which may be performed by means of the developing unit.

The developing unit is not particularly limited as long as it is capable of performing developing by means of the toner of the present invention or the developer, and may be properly selected depending on the intended purpose. Suitable examples include those having at least a developing device, which is capable of housing the toner of the present invention or the developer therein and is capable of directly or indirectly applying the toner or developer to the latent electrostatic image. A developing device equipped with the toner container is more preferable.

The developing device may be of dry developing type or wet developing type, and may be designed either for monochrome or multiple-color. Suitable examples include those having an agitation unit for agitating the toner or developer to provide electrical charges by frictional electrification, and a rotatable magnetic roller.

In the developing device, the toner and carrier are mixed together and the toner is charged by friction, allowing the rotating magnetic roller to bear toner particles in such a way that they stand on its surface, in this way a magnetic blush is formed. Since the magnetic roller is arranged in the vicinity of the latent electrostatic image bearing member (photoconductor), some toner particles on the magnetic roller that constitute the magnetic blush electrically migrate to the surface of the latent electrostatic image bearing member (photoconductor). As a result, a latent electrostatic image is developed by means of the toner, forming a visible image on the surface of the latent electrostatic image bearing member (photoconductor).

The developer contained in the developing device is a developer containing the toner of the present invention. The developer may be of a one-component developer or a two-component developer. The toner contained in the developer is the toner of the present invention.

Transferring Step and Transferring Unit

The transferring step is a step of transferring the visible image onto a recording medium. A preferred embodiment of transferring involves two steps: primary transferring in which the visible image is transferred onto an intermediate transferring medium, and secondary transferring in which the visible image transferred onto the intermediate transferring medium is transferred onto a recording medium. A more preferable embodiment of transferring involves two steps: primary transferring in which a visible image is transferred onto an intermediate transferring medium to form a complex image thereon by means of toners of two or more different colors, preferably full-color toners; and secondary transferring in which the complex image is transferred onto a recording medium.

The transferring step is achieved by, for example, charging the latent electrostatic image bearing member (photoconductor) by means of a transfer charging unit. This transferring step is performed by means of the transferring unit. A preferable embodiment of the transferring unit has two units: a primary transferring unit configured to transfer a visible image onto an intermediate transferring medium to form a complex image; and a secondary transferring unit configured to transfer the complex image onto a recording medium.

The intermediate transferring medium is not particularly limited and can be selected from conventional transferring media depending on the intended purpose; suitable examples include transferring belts.

The transferring unit (i.e., the primary and secondary transferring steps) preferably contains a transferring device configured to charge and separate the visible image from the latent electrostatic image bearing member (photoconductor) and transfer it onto the recording medium. The number of the transferring step to be provided may be either 1 or more.

Examples of the transferring devices include corona transferring devices utilizing corona discharge, transferring belts, transferring rollers, pressure-transferring rollers, and adhesion-transferring devices.

The recording medium may be properly selected from conventional recording media (recording sheets).

The fixing step is a step of fixing a transferred visible image onto a recording medium by means of the fixing unit. Fixing may be performed every time after each color toner has been transferred to the recording medium or may be performed in a single step after all different toners have been transferred to the recording medium.

The fixing device may be properly selected depending on the purpose, preferable examples include conventional heating-pressurizing units. The heating-pressurizing unit is preferably a combination of a heating roller and a pressurizing roller, or a combination of a heating roller, a pressurizing roller, and an endless belt, for example.

In general, heating treatment by means of the heating-pressurizing unit is preferably performed at a temperature of 80° C. to 200° C.

In the present invention, conventional optical fixing units may be used in combination with or instead of the fixing step and fixing unit, depending on the intended purpose.

The charge eliminating step is a step of applying a bias to the charged latent electrostatic image bearing member for elimination of charges, which is suitably performed by means of the charge eliminating unit.

The charge eliminating unit is not particularly limited as long as it is capable of applying a charge eliminating bias to the latent electrostatic image bearing member, and can be appropriately selected from known charge eliminating units depending on the intended purpose. A suitable example thereof is a charge eliminating lamp and the like.

The cleaning step is a step of removing toner particles remained on the latent electrostatic image bearing member. This is suitably performed by means of the cleaning unit. The cleaning unit is not particularly limited as long as it is capable of eliminating such toner particles from the latent electrostatic image bearing member, and can be suitably selected from known cleaners depending on the intended use. Examples thereof include a magnetic blush cleaner, an electrostatic brush cleaner, a magnetic roller cleaner, a blade cleaner, a blush cleaner, and a wave cleaner The recycling step is a step of recycling the toner particles removed through the cleaning step to the developing unit. This is suitably performed by means of the recycling unit. The recycling unit may be properly selected from conventional conveyance systems.

The controlling step is a step of controlling the foregoing steps. This is suitably performed by means of the controlling unit.

The controlling unit is not particularly limited as long as the operation of each step can be controlled, and may be properly selected depending on the purpose. Examples thereof include equipment such as sequencers and computers.

One embodiment of the image forming method of the present invention by means of the image forming apparatus will be described with reference to FIG. 3. Image forming apparatus 100 shown in FIG. 3 contains photoconductor drum 10 (hereinafter referred to as "photoconductor 10") as the latent electrostatic image bearing member, charging roller 20 as the charging unit, exposure device 30 as the exposing unit, developing device 40 as the developing unit, intermediate transferring member 50, cleaning device 60 as the cleaning unit having a cleaning blade, and charge eliminating lamp 70 as the charge eliminating unit.

Intermediate transferring member 50 is an endless belt, and is so designed that it loops around three rollers 51 disposed its inside and rotates in the direction shown by the arrow by means of rollers 51. One or more of three rollers 51 also functions as a transfer bias roller capable of applying a certain transfer bias (primary bias) to the intermediate transferring member 50. Cleaning blade 90 is provided adjacent to the intermediate transferring member 50. There is provided transferring roller 80 facing to the intermediate transferring member 50 as the transferring unit capable of applying a transfer bias so as to transfer a developed image (toner image) to transfer sheet 95 as a recording medium (secondary transferring). Moreover, there is provided a corona charger 58 around the intermediate transferring member 50 for applying charges to the toner image transferred on the intermediate transferring medium 50. Corona charger 58 is arranged between the contact region of the photoconductor 10 and the intermediate transferring medium 50 and the contact region of the intermediate transferring medium 50 and the transfer sheet 95, in the rotational direction of the intermediate transferring medium 50.

Developing device 40 contains developing belt 41 as a developer bearing member, black developing unit 45K, yellow developing unit 45Y, magenta developing unit 45M and cyan developing unit 45C, these developing units being positioned around the developing belt 41. The black developing unit 45K contains developer container 42K, developer supplying roller 43K, and developing roller 44K. The yellow developing unit 45Y contains developer container 42Y, developer supplying roller 43Y, and developing roller 44Y. The magenta developing unit 45M contains developer container 42M, developer supplying roller 43M, and developing roller 44M. The cyan developing unit 45C contains developer container 42C, developer supplying roller 43C, and developing roller 44C. The developing belt 41 is an endless belt looped around a plurality of belt rollers so as to be rotatable. A part of the developing belt 41 is in contact with the photoconductor 10.

Figure 3:
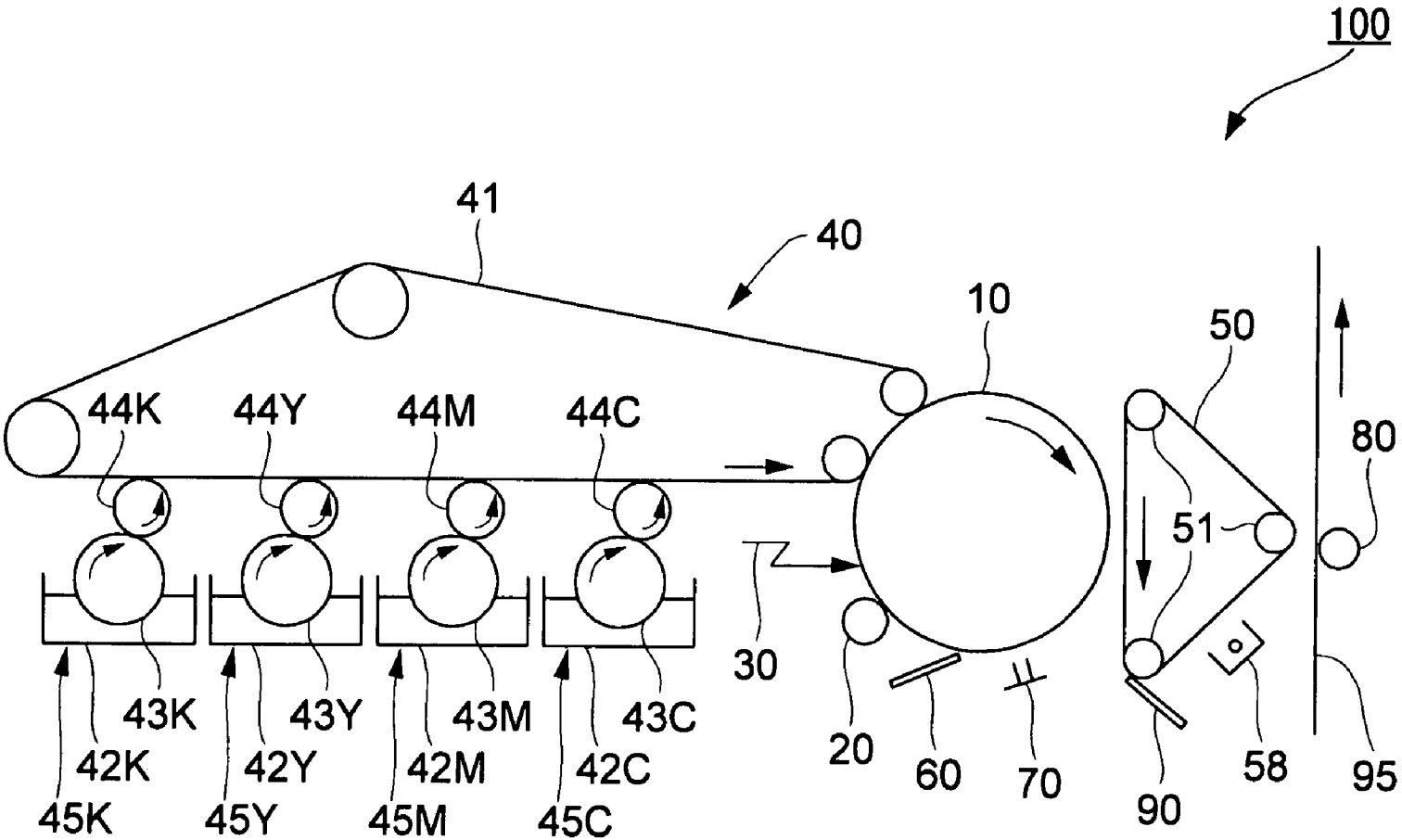
FIG. 3 is a schematic view that explains exemplarily an inventive image forming method by use of an inventive image forming apparatus.

In image forming apparatus 100 shown in FIG. 3, the photoconductor drum 10 is uniformly charged by means of, for example, the charging roller 20. The exposure device 30 then exposes imagewisely on the photoconductor drum 10 so as to form a latent electrostatic image. The latent electrostatic image formed on the photoconductor drum 10 is provided with toner from the developing device 40 to form a visible image (toner image). The roller 51 applies a bias to the toner image to transfer the visible image (toner image) onto the intermediate transferring medium 50 (primary transferring), and further applies a bias to transfer the toner image from the intermediate transferring medium 50 to the transfer sheet 95 (secondary transferring). In this way a transferred image is formed on the transfer sheet 95. Thereafter, toner particles remained on the photoconductor drum 10 are removed by means of the cleaning device 60, and charges of the photoconductor drum 10 are removed by means of charge eliminating lamp 70 on a temporary basis.

Figure 4:
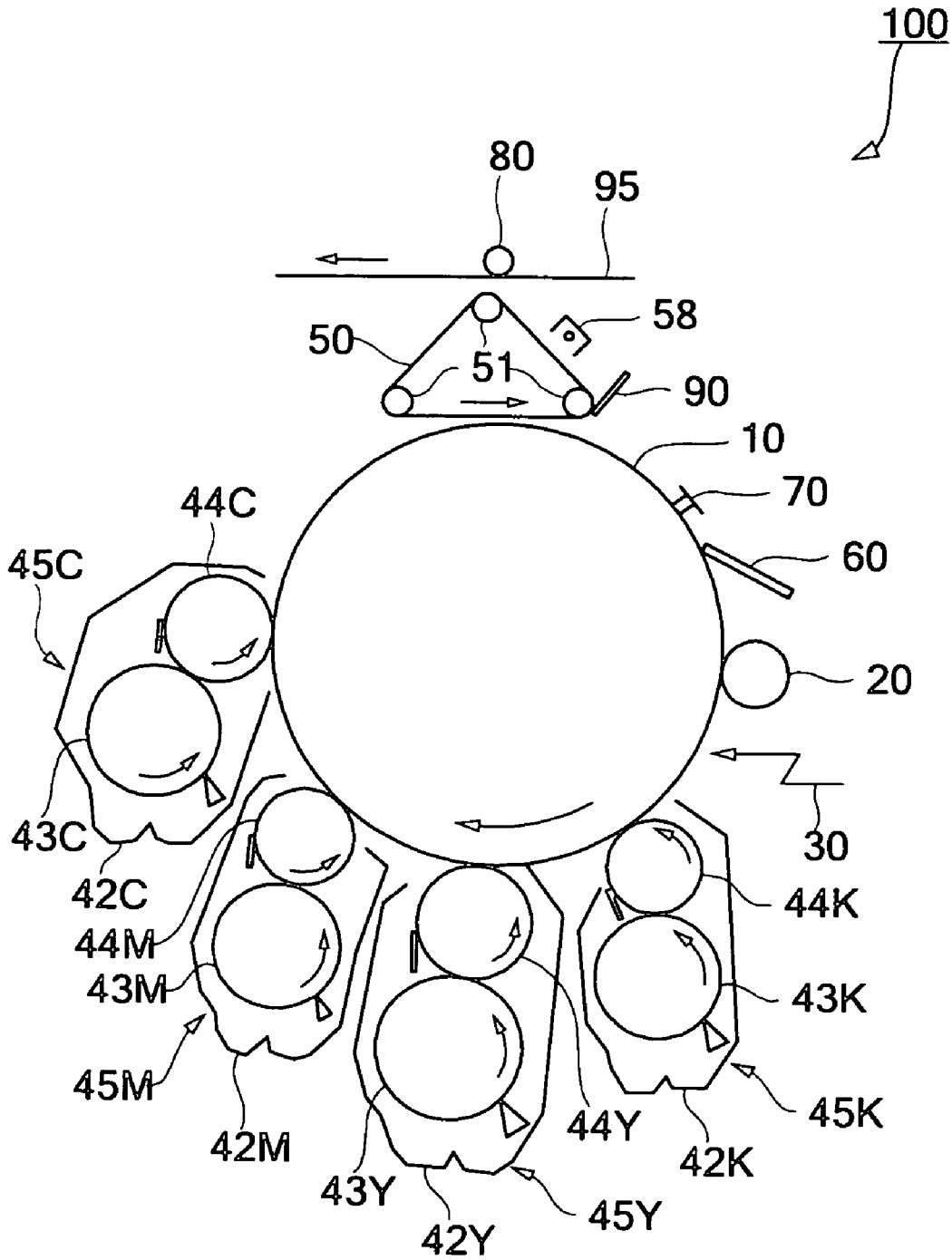
FIG. 4 is a schematic view that explains exemplarily another inventive image forming method by use of an inventive image forming apparatus.

Another embodiment of the image forming method of the present invention by means of the image forming apparatus will be described with reference to FIG. 4. The image forming apparatus 100 shown in FIG. 4 has an identical configuration and working effects to those of the image forming apparatus 100 shown in FIG. 3 except that this image forming apparatus 100 does not contains the developing belt 41 and that the black developing unit 45K, yellow developing unit 45Y, magenta developing unit 45M and cyan developing unit 45C are disposed so as to face the photoconductor 10. Note in FIG. 4 that members identical to those in FIG. 3 are denoted by the same reference numerals.

Figure 5:
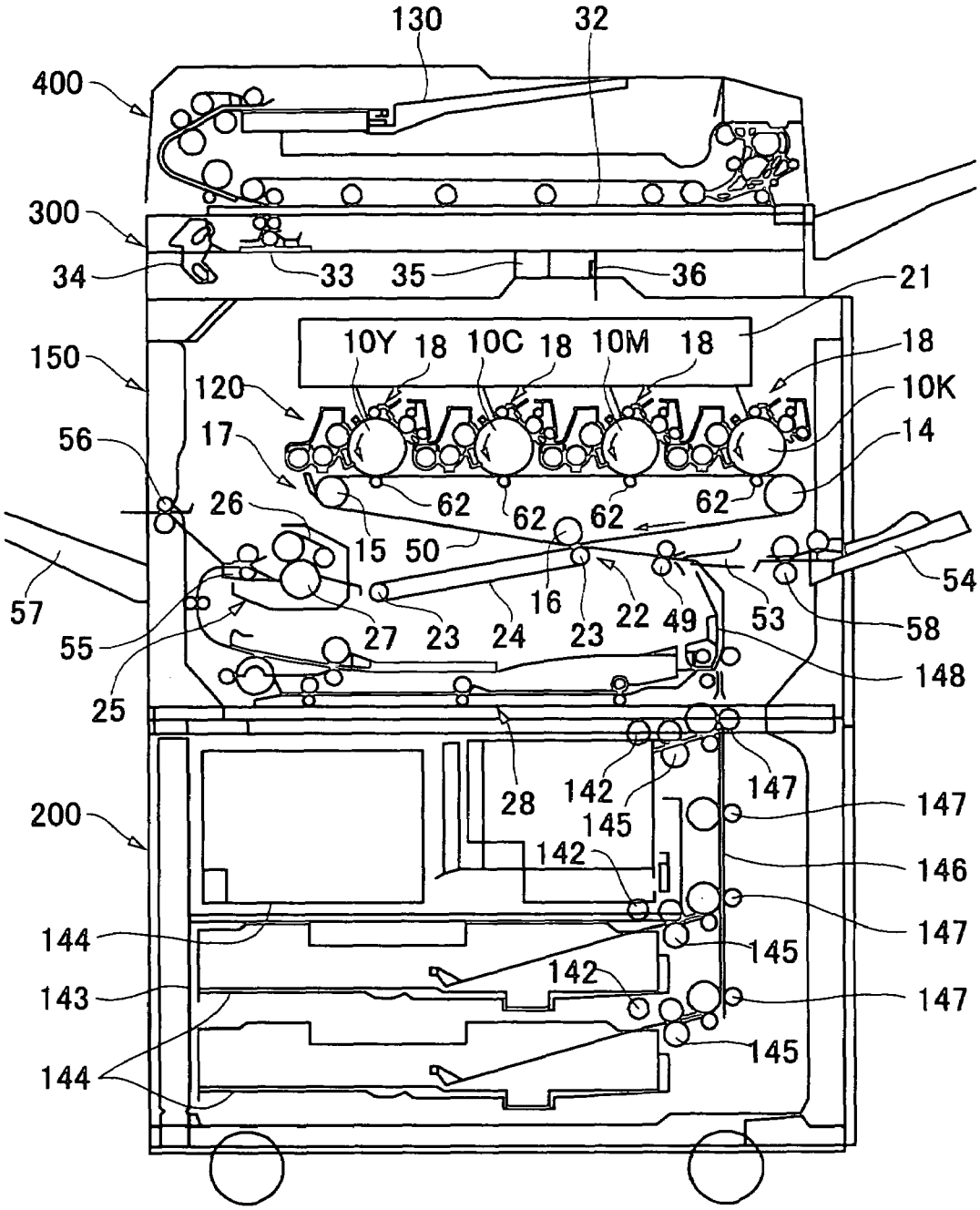
FIG. 5 is a schematic view that explains exemplarily an inventive image forming method by use of an inventive image forming apparatus of a tandem color image forming apparatus.

Still another embodiment of the image forming method of the present invention by means of the image forming apparatus will be described with reference to FIG. 5. Image forming apparatus shown in FIG. 5 is a tandem color image-forming apparatus. The tandem image forming apparatus contains copy machine main body 150, feeder table 200, scanner 300, and automatic document feeder (ADF) 400.

The copy machine main body 150 has an endless-belt intermediate transferring member 50 in the center. The intermediate transferring member 50 is looped around support rollers 14, 15 and 16 and is configured to be rotatable in a clockwise direction in FIG. 5. A cleaning device for intermediate transferring member 17 for the intermediate transferring member is provided in the vicinity of the support roller 15. The cleaning device for intermediate transferring member 17 removes toner particles remained on the intermediate transferring member 50. On the intermediate transferring member 50 looped around the support rollers 14 and 15, four color-image forming devices 18 of yellow, cyan, magenta, and black are aligned along the conveying direction so as to face the intermediate transferring member 50, which constitutes a tandem developing unit 120. Exposing unit 21 is arranged adjacent to the tandem developing unit 120. Secondary transferring unit 22 is arranged across the intermediate transferring member 50 from the tandem developing unit 120. The secondary transferring unit 22 contains secondary transferring belt 24, which is an endless belt and looped around a pair of rollers 23. A transferred sheet which is conveyed on the secondary transferring belt 24 is allowed to contact the intermediate transferring member 50. Image fixing unit 25 is arranged in the vicinity of the secondary transferring unit 22. The image fixing unit 25 contains fixing belt 26 which is an endless belt, and pressurizing roller 27 which is pressed by the fixing belt 26.

In the tandem image forming apparatus, sheet reverser 28 is arranged adjacent to both the secondary transferring unit 22 and image fixing unit 25. Sheet reverser 28 turns over a transferred sheet to form images on the both sides of the sheet.

Next, full-color image formation (color copying) using tandem developing unit 120 will be described. At first, a source document is placed on document tray 130 of automatic document feeder 400. Alternatively, the automatic document feeder 400 is opened, the source document is placed on contact glass 32 of scanner 300, and the automatic document feeder 400 is closed.

When a start switch (not shown) is pushed, the source document placed on the automatic document feeder 400 is transferred onto the contact glass 32, and the scanner 300 is then driven to operate first and second carriages 33 and 34. In a case where the source document is originally placed on the contact glass 32, the scanner 300 is immediately driven after pushing of the start switch. Light is applied from a light source to the document by means of the first carriage 33, and light reflected from the document is further reflected by the mirror of the second carriage 34. The reflected light passes through the image-forming lens 35, and read the sensor 36 receives it. In this way the color document (color image) is scanned, producing 4 types of color image information of black, yellow, magenta, and cyan.

Figure 6:
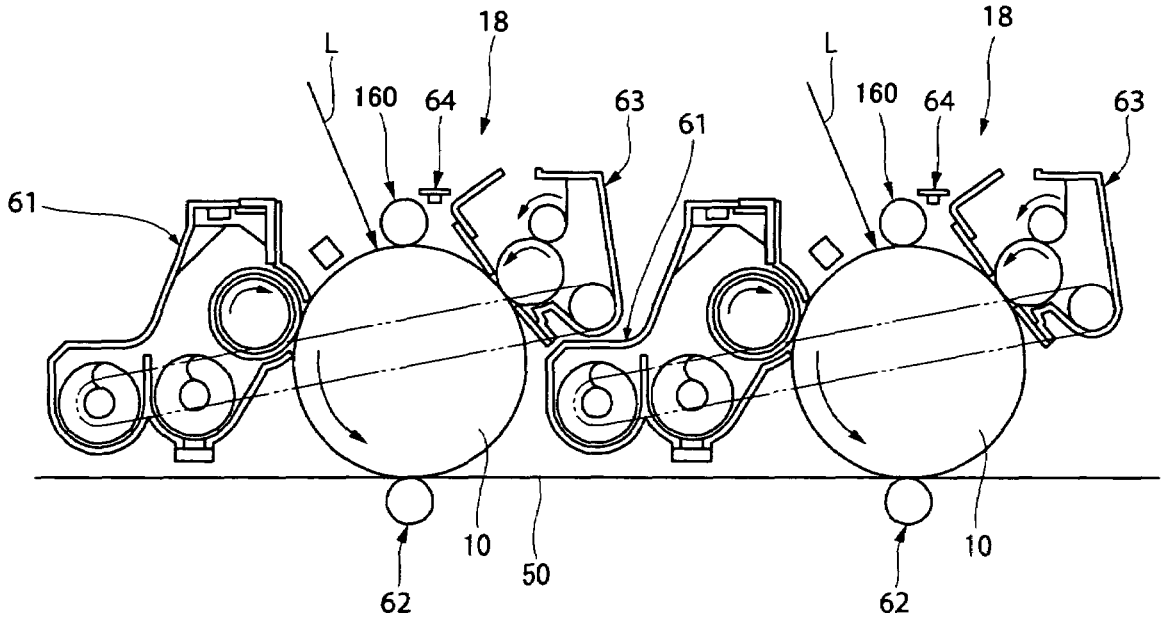
FIG. 6 is a partially enlarged schematic view of the image forming apparatus shown in FIG. 5.

Each image information of black, yellow, magenta, and cyan is transmitted to image forming unit 18 (black image forming unit, yellow image forming unit, magenta image forming unit, or cyan image forming unit) of the tandem developing unit 120, and toner images of each color are formed in each image-forming unit 18. As shown in FIG. 6, each image-forming unit 18 (black image-forming unit, yellow image forming unit, magenta image forming unit, and cyan image forming unit) of the tandem developing unit 120 contains: photoconductor 10 (photoconductor for black 10K, photoconductor for yellow 10Y, photoconductor for magenta 10M, or photoconductor for cyan 10C); charging device 160 for uniformly charging the photoconductor 10; an exposing unit for forming a latent electrostatic image corresponding to the color image on the photoconductor by exposing imagewisely (denoted by "L" in FIG. 6) on the basis of the corresponding color image information; developing device 61 for developing the latent electrostatic image using the corresponding color toner (black toner, yellow toner, magenta toner, or cyan toner) to form a toner image; transfer charger 62 for transferring the toner image to intermediate transferring member 50, cleaning device 63, and charge eliminating device 64. Thus, images of one color (a black image, a yellow image, a magenta image, and a cyan image) can be formed based on the color image information. The black toner image formed on the photoconductor for black 10K, yellow toner image formed on the photoconductor for yellow 10Y, magenta toner image formed on the photoconductor for magenta 10M, and cyan toner image formed on the photoconductor for cyan 10C are sequentially transferred onto the intermediate transferring member 50 which rotates by means of support rollers 14, 15 and 16 (primary transferring). These toner images are superimposed on the intermediate transferring member 50 to form a composite color image (color transferred image).

Meanwhile, one of feed rollers 142 of the feed table 200 is selected and rotated, whereby sheets (recording sheets) are ejected from one of multiple feed cassettes 144 in paper bank 143 and are separated one by one by separation roller 145. Thereafter, the sheets are fed to feed path 146, transferred by transfer roller 147 into feed path 148 inside the copying machine main body 150, and are bumped against the resist roller 49 to stop. Alternatively, one of the feed rollers 142 is rotated to eject sheets (recording sheets) placed on manual feed tray 54. The sheets are then separated one by one by means of the separation roller 145, fed into manual feed path 53, and similarly, bumped against the resist roller 49 to stop. The resist roller 49 is generally earthed, but it may be biased for removing paper dusts on the sheets. The resist roller 49 is rotated synchronously with the movement of the composite color image (color transferred image) on the intermediate transferring member 50 to transfer the sheet (recording sheet) into between the intermediate transferring member 50 and the secondary transferring unit 22, and the composite color image (color transferred image) is transferred onto the sheet by means of the secondary transferring unit 22 (secondary transferring). In this way the color image is formed on the sheet (recording sheet). After image transferring, toner particles remained on the intermediate transferring member 50 are cleaned by means of the cleaning device for intermediate transferring member 17.

The sheet (recording sheet) bearing the transferred color image is conveyed by the secondary transferring unit 22 into the image fixing unit 25, where the composite color image (color transferred image) is fixed onto the sheet (recording sheet) by heat and pressure. Thereafter, the sheet changes its direction by action of switch hook 55, ejected by ejecting roller 56, and stacked on output tray 57. Alternatively, the sheet changes its direction by action of the switch hook 55, flipped over by means of the sheet reverser 28, and transferred back to the image transfer section for recording of another image on the other side. The sheet that bears images on both sides is then ejected by means of the ejecting roller 56, and is stacked on the output tray 57.

The image forming apparatuses and image forming methods according to the present invention may provide efficiently high-quality images by virtue of the inventive toners that are superior in terms of coloring, releasing, charging and surface properties.

EXAMPLES

Hereinafter, the present invention will be explained with reference to examples, but which should not be construed to limit the present invention. All numerical expressions expressed by "part" mean "part by weight" unless indicated otherwise.

Example 1

Preparation of Toner Base Particles 1

Preparation of Polymerizable Monomer for Core

A polymerizable monomer containing 80 parts of styrene and 20 parts of n-butylacrylate (glass-transition temperature Tg of the copolymer=55° C.), 7 parts of carbon black (by Mitsubishi Chemical Co., #25B), 1 part of charge control agent (Hodogaya Chemical Co., Spiron Black TRH), 0.3 part of divinylbenzene, 0.8 parts of tert-dodecylmercaptan, 10 parts of pentaerythritol tetrastearate (stearic acid, purity: about 60%) and 2 parts of natural gas-based Fischer-Tropsh wax (by D Shell MS Co., FT-100, melting point: 92° C.) were vigorously mixed to disperse uniformly together using TK homomixer (a high-shearing force mixer manufactured by Tokushu Kika Co.) at 11,000 rpm, thereby to prepare a polymerizable monomer composition for cores.

Preparation of Polymerizable Monomer for Shell

A mixture of 5 parts of methylmethacrylate resin (Tg=105° C.) and 100 parts of water was finely dispersed using a ultrasonic emulsifier (by Tokushu Kika Co., TK Homomixer) thereby to prepare an aqueous dispersion of a polymerizable monomer for shells.

Preparation of Magnesium Hydroxide Colloid Dispersion

To a solution of 250 parts of deionized water and 9.8 parts of magnesium chloride (water-soluble polyvalent metal salt), an aqueous solution of 50 parts of deionized water and 0.69 parts of sodium hydroxide (alkaline metal hydroxide) was slowly added under stirring, thereby a dispersion of magnesium hydroxide colloid (a colloid of less-soluble metal compound) was prepared.

Into the resulting dispersion of magnesium hydroxide colloid, the aforementioned polymerizable monomer composition for cores was poured and mixed, then 4 parts of tert-butylperoxy-2-ethylhexanoate was added, and the mixture was stirred under a high-shear rate at 11,000 rpm, thereby droplets of the polymerizable monomer composition for cores were granulated using TK homomixer. The aqueous dispersion of the granulated monomer composition was poured into a polymerization reactor equipped with a stirring blade, a polymerization reaction was caused at 90° C. When the polymerization rate came to almost 100%, the aqueous dispersion of the polymerizable monomer for shells as well as 1 part of 1% aqueous solution of potassium peroxodisulfate were added; after the reaction was continued for 5 hours, the reaction was stopped thereby to prepare an aqueous dispersion of core-shell type polymer particles.

The resulting dispersion of core-shell type polymer particles was adjusted its pH to no more than 4 by use of sulfuric acid while stirring, then was subjected sequentially to acid cleaning at 25° C. for 10 minutes, water-separation by filtration, re-slurrying with additional 500 parts of deionized water and aqueous cleaning. After the dewatering and the aqueous cleaning were repeated several times and the solid content was filtrated and separated, the solid was dried at 45° C. for 24 hours thereby to obtain Toner Base Particles 1 (Resin Fine Particles 1).

Step of Forming Coating Layer

The resulting Toner Base Particles 1 (Resin Fine Particles 1) of 10 g and a charge control agent (by Clariant Japan Co., Copy Charge PSY) of 1 g as a material for coating layer were filled into a processing cell, to which 100 ml of ethanol (purity >99.5%) was added as an aid-solvent. Then carbon dioxide, selected for the supercritical fluid, was fed into the processing cell from a steel bottle, the upper-limit pressure was adjusted by a control valve and the temperature was controlled to 313.15±0.5 K. The protective tube was controlled to 350.15±0.5 K.

The processing space was maintained in a closed condition (e.g. all valves were closed), and carbon dioxide gas was fed to the processing cell (e.g. the valve of carbon dioxide gas was opened to feed the carbon dioxide gas). The carbon dioxide gas was fed continuously to pressurize the processing space to a processing pressure. The inside of the processing cell was stirred by a stirrer, the rotation speed of the stirrer shaft was controlled by a digital rotation controller, and the carbon dioxide at a supercritical condition was supplied in a condition of 5.0 L/min of feed rate (corresponding value at normal condition), 70° C., 40.52 MPa (400 atm) and 5 hours, a coating layer containing the charge control agent was formed on the toner surface thereby to obtain Toner 1. The period for forming the coating layer was 30 minutes.

After the toner was prepared, the carbon dioxide dissolving the charge control agent in the processing cell was displaced into a supercritical fluid having no dissolved material, the processing space was turned into normal pressure, then the toner was recovered from the inside of the processing cell.

Toners obtained in such ways require neither drying process nor cleaning process; in addition, following the step of forming a coating layer, the production process can be completed after merely removing the carbon dioxide gas by reducing the pressure within the reaction vessel containing the supercritical fluids. Accordingly, toners can be produced with remarkably shorter periods and higher efficiencies, and also removal of waste liquids can result in reduction of environmental loads.

Comparative Example 1

Preparation of Comparative Toner 1

Comparative Toner 1 was prepared in the same manner as Example 1, except for eliminating the step of forming a coating layer.

Preparation of Developer

Toner 1 and Comparative Toner 1 of each 100 parts were respectively added with 0.8 part of hydrophobitized silica (by Japan Aerosil Co, NA50H) having a volume average particle diameter of 12 nm, then were surface-treated by use of Henschel mixer thereby to prepare Developer 1 (positive charging) and Comparative Developer 2 (positive charging).

Example 2

Preparation of Toner Base Particles 2

A hermetically-sealable reaction vessel equipped with a blade stirrer, a cooling condenser and a nitrogen gas inlet was installed in a temperature-controlled water bath. To the reaction vessel, 70 parts of ethanol, 30 parts of distilled water, and 4 parts by of polyvinylpyrolidone were filled, then the blade stirrer was rotated to completely dissolve polyvinylpyrolidone. Then the reaction vessel was charged with 28 parts of styrene, 10 parts of ethylacrylate, 2 parts of n-butyl methacrylate, 0.2 part of ethyleneglycol dimethacrylate, 0.03 part of carbon tetrachloride, and 0.6 part of benzoyl peroxide. While rotating the blade stirrer, nitrogen gas was introduced in the vessel to completely remove oxygen therefrom, then the water bath was heated to 50±0.1° C. to start polymerization reaction. Two hours later, the water bath was heated to 65±0.1° C. to raise the reaction rate.

After 12 hours from the initiation of the polymerization reaction, the water bath was cooled to room temperature to prepare a dispersion. An aliquot of the dispersion was analyzed by gas chromatography using a standard method, consequently the polymerization degree was confirmed to be above 90%. Particle size distribution measurement using Coulter Multisizer (100 μm aperture tube) revealed that Toner Base Particles 2 (Resin Fine Particles 2) had a volume average particle diameter of 6.83 μm, a number average particle diameter of 6.04 μm and the ratio of 1.131.

Step of Forming Coating Layer

Step of Forming Release Agent-Coating Layer

The resulting 100 parts of Toner Base Particles 2 (Resin Fine Particles 2) and 5 parts of Carnauba wax (melting point 82° C.) for the release agent-coating layer were filled into a pressure cell.

Then carbon dioxide, selected for the supercritical fluid, was fed into the processing cell from a steel bottle, the upper-limit pressure was adjusted by a control valve and the temperature was controlled to 313.15±0.5 K. The protective tube was controlled to 350.15±0.5 K. The processing space was maintained in a closed condition (e.g. all valves were closed), and carbon dioxide gas was fed to the processing cell (e.g. the valve of carbon dioxide gas was opened to feed the carbon dioxide gas).

The carbon dioxide gas was fed continuously to pressurize the processing space to a processing pressure. The inside of the processing cell was stirred by a stirrer, the rotation speed of the stirrer shaft was controlled by a digital rotation controller, and the carbon dioxide at a supercritical condition was supplied in a condition of 5.0 L/min of feed rate (corresponding value at normal condition), 70° C., 40.52 MPa (400 atm) and 5 hours, thereby to prepare Toner Base Particles 2a (Resin Fine Particles 2a) in which a coating layer of the wax was formed on the surface of the resin fine particles.

Step of Forming Resin-Coating Layer

Next, 10 parts of methylmethacrylate resin (Tg: 104° C.) and 50 parts of ethanol as an aid-solvent were filled into a processing cell containing Toner Base Particles 2a (Resin Fine Particles 2a). Then carbon dioxide, selected for the supercritical fluid, was fed into the processing cell from a steel bottle, the upper-limit pressure was adjusted by a control valve and the temperature was controlled to 313.15±0.5 K. The protective tube was controlled to 350.15±0.5 K. The processing space was maintained in a closed condition (e.g. all valves were closed), and carbon dioxide gas was fed to the processing cell (e.g. the valve of carbon dioxide gas was opened to feed the carbon dioxide gas). The carbon dioxide gas was fed continuously to pressurize the processing space to a processing pressure. The inside of the processing cell was stirred by a stirrer, the rotation speed of the stirrer shaft was controlled by a digital rotation controller, and the carbon dioxide at a supercritical condition was supplied in a condition of 70° C. and 40.52 MPa (400 atm) for 3 hours followed by 35° C. and 31 MPa for 1 hour, then the carbon dioxide of the supercritical condition was fed at 5.0 L/min (corresponding value at normal condition), thereby to prepare Toner Base Particles 2b (Resin Fine Particles 2b) in which a coating layer of the resin was formed on the surface of the Toner Base Particles 2a (Resin Fine Particles 2a).

Step of Forming Charge Control Agent-Coating Layer

Next, 100 parts of the resulting Toner Base Particles 2b (Resin Fine Particles 2b) and 10 parts of a charge control agent (by Clariant Japan Co., Copy Charge PSY) as a material for coating layer were filled into a processing cell, to which 1,000 parts of ethanol (purity >99.5%) was added as an aid-solvent. Then carbon dioxide, selected for the supercritical fluid, was fed into the processing cell from a steel bottle, the upper-limit pressure was adjusted by a control valve and the temperature was controlled to 313.15±0.5 K. The protective tube was controlled to 350.15±0.5 K. The processing space was maintained in a closed condition (e.g. all valves were closed), and carbon dioxide gas was fed to the processing cell (e.g. the valve of carbon dioxide gas was opened to feed the carbon dioxide gas). The carbon dioxide gas was fed continuously to pressurize the processing space to a processing pressure. The inside of the processing cell was stirred by a stirrer, the rotation speed of the stirrer shaft was controlled by a digital rotation controller, and the carbon dioxide at a supercritical condition was supplied in a condition of 5.0 L/min (corresponding value at normal condition), 70° C. and 40.52 MPa (400 atm) for 5 hours, thereby to prepare Toner Base Particles 2c (Resin Fine Particles 2c) in which a coating layer of the charge control agent was formed on the surface of the Toner Base Particles 2b (Resin Fine Particles 2b).

Step of Forming Colorant-Coating Layer

Next, 12 parts of Solvent Black and 100 parts of the Toner Base Particles 2c (Resin Fine Particles 2c) were filled into the processing cell. Then carbon dioxide, selected for the supercritical fluid, was fed into the processing cell from a steel bottle, the upper-limit pressure was adjusted by a control valve and the temperature was controlled to 313.15±0.5 K. The protective tube was controlled to 350.15±0.5 K. The processing space was maintained in a closed condition (e.g. all valves were closed), and carbon dioxide gas was fed to the processing cell (e.g. the valve of carbon dioxide gas was opened to feed the carbon dioxide gas). The carbon dioxide gas was fed continuously to pressurize the processing space to a processing pressure. The inside of the processing cell was stirred by a stirrer, the rotation speed of the stirrer shaft was controlled by a digital rotation controller, and the carbon dioxide at a supercritical condition was supplied in a condition of 5.0 L/min (corresponding value at normal condition), 70° C. and 40.52 MPa (400 atm) for 5 hours, thereby to color the Toner Base Particles 2c (Resin Fine Particles 2c), and the preparation of the Toner 2 was complete.

Toner 2 obtained from the these steps requires neither a drying process nor a cleaning process; in addition, following the step of forming a coating layer and the step of forming a colorant layer, the production process can be completed after merely removing the carbon dioxide gas by reducing the pressure within the reaction vessel containing the supercritical fluids. Accordingly, toners can be produced with remarkably shorter periods and higher efficiencies, and also removal of waste liquids can result in reduction of environmental loads.

Example 3

Preparation of Toner 3

Toner 3 was prepared in the same manner as Example 2, except that the step of forming a colorant-coating layer was changed as follows.

Step of Forming Colorant-Coating Layer

Next, 4.8 parts of Oil Black HBB (Orient Chemical Industries, Ltd.), 1.2 parts of Oil Orange 201 (Orient Chemical Industries, Ltd.), and 100 parts of Toner Base Particles 2c (Resin Fine Particles 2c) prepared in Example 2 were filled into the pressure cell described above. Then carbon dioxide, selected for the supercritical fluid, was fed into the processing cell from a steel bottle, the upper-limit pressure was adjusted by a control valve and the temperature was controlled to 313.15±0.5 K. The protective tube was controlled to 350.15±0.5 K. The processing space was maintained in a closed condition (e.g. all valves were closed), and carbon dioxide gas was fed to the processing cell (e.g. the valve of carbon dioxide gas was opened to feed the carbon dioxide gas). The carbon dioxide gas was fed continuously to pressurize the processing space to a processing pressure. The inside of the processing cell was stirred by a stirrer, the rotation speed of the stirrer shaft was controlled by a digital rotation controller, and the carbon dioxide at a supercritical condition was supplied in a condition of 5.0 L/min (corresponding value at normal condition), 70° C. and 40.52 MPa (400 atm) for 3 hours, thereby the Toner Base Particles 2c (Resin Fine Particles 2c) prepared in Example 2 was colored to prepare Toner 3.

In addition, Toner 3 obtained from the such steps requires neither a drying process nor a cleaning process; furthermore, following the step of forming a coating layer and the coloring step, the production process can be completed after merely removing the carbon dioxide gas by reducing the pressure within the reaction vessel containing the supercritical fluids. Accordingly, toners can be produced with remarkably shorter periods and higher efficiencies, and also removal of waste liquids can result in reduction of environmental loads.

Examples 4 to 6

Preparation of Toners 4 to 6

Using the Toner Base Particles 2a (Resin Fine Particles 2a) prepared in Example 2, Toner Base Particles 2d (Resin Fine Particles 2d) having no resin-coating layer was prepared by carrying out the step of forming a charge control agent-coating layer of Example 2 without carrying out the step of forming a resin-coating layer.

Next, Toners 4 to 6 were prepared in the same manner as Example 2 except that Toner Base Particles 2c (Resin Fine Particles 2c) was exchanged to Toner Base Particles 2d (Resin Fine Particles 2d) in the step of forming a colorant-coating layer in Example 2 and the dyes shown in Table 1 were employed.

TABLE 1

| | Dye | Part by Mass |
|---|---|---|
| Toner 4 | C.I. Solvent Yellow 35 | 10 |
| Toner 5 | C.I. Solvent Red 151 | 8 |
| Toner 6 | C.I. Solvent Blue 22 | 7 |

Example 7

Preparation of Toner 7

Toner 7 was prepared in the same manner as Example 2, except that the step of forming a charge control agent-coating layer was changed as follows.

Step of Forming Charge Control Agent-Coating Layer

One part of TN-105 (by Hodogaya Chemical Co., zirconium salicylate) as a charge control agent for forming the coating layer and 10 parts of Toner Base Particles 2b (Resin Fine Particles 2b) prepared in Example 2 were filled into a processing cell, to which 100 ml of ethanol (purity >99.5%) was added as an aid-solvent. Then carbon dioxide, selected for the supercritical fluid, was fed into the processing cell from a steel bottle, the upper-limit pressure was adjusted by a control valve and the temperature was controlled to 313.15±0.5 K. The protective tube was controlled to 350.15±0.5 K.

The processing space was maintained in a closed condition (e.g. all valves were closed), and carbon dioxide gas was fed to the processing cell (e.g. the valve of carbon dioxide gas was opened to feed the carbon dioxide gas). The carbon dioxide gas was fed continuously to pressurize the processing space to a processing pressure. The inside of the processing cell was stirred by a stirrer, the rotation speed of the stirrer shaft was controlled by a digital rotation controller, and the carbon dioxide at a supercritical condition was supplied in a condition of 5.0 L/min (corresponding value at normal condition), 80° C. and 40.52 MPa (400 atm) for 5 hours, thereby a coating layer of the charge control agent was formed on the surface of the Toner Base Particles 2b (Resin Fine Particles 2b) prepared in Example 2.

Example 8

Preparation of Toner 8

Toner 8 was prepared in the same manner as Example 2, except that the step of forming a charge control agent-coating layer was changed as follows.

Step of Forming Charge Control Agent-Coating Layer

One part of E-84 (by Hodogaya Chemical Co., zinc salicylate) as a charge control agent for forming the coating layer and 10 parts of Toner Base Particles 2b (Resin Fine Particles 2b) prepared in Example 2 were filled into a processing cell, to which 100 ml of ethanol (purity >99.5%) was added as an aid-solvent. Then carbon dioxide, selected for the supercritical fluid, was fed into the processing cell from a steel bottle, the upper-limit pressure was adjusted by a control valve and the temperature was controlled to 313.15±0.5 K. The protective tube was controlled to 350.15±0.5 K.

The processing space was maintained in a closed condition (e.g. all valves were closed), and carbon dioxide gas was fed to the processing cell (e.g. the valve of carbon dioxide gas was opened to feed the carbon dioxide gas). The carbon dioxide gas was fed continuously to pressurize the processing space to a processing pressure. The inside of the processing cell was stirred by a stirrer, the rotation speed of the stirrer shaft was controlled by a digital rotation controller, and the carbon dioxide at a supercritical condition was supplied in a condition of 5.0 L/min (corresponding value at normal condition), 80° C. and 40.52 MPa (400 atm) for 5 hours, thereby a coating layer of the charge control agent was formed on the surface of the Toner Base Particles 2b (Resin Fine Particles 2b) prepared in Example 2.

Comparative Example 2

Preparation of Comparative Toner 2

Comparative Toner 2 was prepared in the same manner as Example 2, except that the step of forming a colorant-coating layer was carried out using no supercritical fluid.

Step of Forming Colorant-Coating Layer

Thirty parts of Solvent Black was dissolved into 20 parts of ethanol under heating, then the mixture was filtered through a filter of 1 μm to remove insoluble matters. Twenty parts of the resulting solution, 100 parts of ethanol, and 100 parts of Toner Base Particles 2c (Resin Fine Particles 2c) prepared in Example 2 were filled into a vessel and the mixture was mixed at 50° C. for 1 hour thereby to color the resin fine particles 2c. Then the coloring liquid was cooled to room temperature, then was subjected to three times of centrifugation, decantation and re-dispersion into ethanol, and then was filtrated.

Preparation of Developer

Using Henschel Mixer, 0.7 part of hydrophobic silica and 0.3 part of hydrophobic titanium oxide were added to the respective Toners 2 to 8 and Comparative Toner 2 of 100 parts. Subsequently, Developers 2 to 8 and Comparative Developer 2 were prepared, each of which consisted of 5% by mass of toner and 95% by mass of silicone resin-coated cupper-zinc ferrite carrier with an average particle diameter of 40 μm. The Toners 2 to 8 and Comparative Toner 2 correspond sequentially to Developers 2 to 8 and Comparative Developer 2.

Each of the developers prepared in Examples 1 to 8 and Comparative Examples 1 to 2 was evaluated in terms of image density, toner adhesion to photoconductors, charge density, and comprehensive evaluation were determined in the following way. The results are shown in Table 2.

Image Density

For each developer, a solid image was formed on copy sheets (Type 6000 (70W), by Ricoh Company, Ltd.) using Imagio Neo 450 (a tandem color image forming apparatus, Ricoh Company, Ltd.), with the deposited amount of developer being 1.00±0.05 mg/cm$^2$. The solid mage was formed repeatedly on 8,000 sheets of copy paper. The image densities of two sheets, i.e. the first and 8,000th sheets, were determined by visual inspection based on the following criteria.

Furthermore, the developers of Example 1 and Comparative Example 1 were evaluated similarly to described above using a laser printer of non-magnetic one-component developing system (by Kyocera Mita Corp., DP-560).

The higher is the image density, images may be formed with higher density. This evaluation corresponds to Examples of toner-containing containers, process cartridges, and image forming methods according to the present invention.

Evaluation Criteria:

A: no image density change between the first and 8,000th sheets, both providing high-image quality;

B: the image density and image quality of the 8,000th sheet are slightly reduced;

C: the image density and image quality of the 8,000th sheet are significantly reduced.

Adhesion

After the image forming, the occurrence of toner adhesion to photoconductors of the respective developers was determined by visual inspection, and evaluations were made based on the following criteria:

A: substantially no developer adhesion on photoconductors

B: slight developer adhesion on photoconductors

Charge Density

Six grams of each developer was measured into a sealable metallic cylinder and blown off to measure the charge density. The toner concentration was adjusted to 4.5% by mass to 5.5% by mass.

Comprehensive Evaluation

By combining the results of the foregoing evaluations, comprehensive evaluations were made on toners based on the following criteria:

A: pass

B: rejection (nonusable)

TABLE 2

| | Toner | Image Density | Toner Adhesion | Charge Density | Compreh. Evaluation |
|---|---|---|---|---|---|
| Ex. 1 | Toner 1 | A | A | +24 | A |
| Ex. 2 | Toner 2 | A | A | −35 | A |
| Ex. 3 | Toner 3 | A | A | −27 | A |
| Ex. 4 | Toner 4 | A | A | −25 | A |
| Ex. 5 | Toner 5 | A | A | −23 | A |
| Ex. 6 | Toner 6 | A | A | −25 | A |
| Ex. 7 | Toner 7 | A | A | −29 | A |
| Ex. 8 | Toner 8 | A | A | −33 | A |
| Comp. Ex. 1 | Comp. Toner 1 | C | B | +10 | B |
| Comp. Ex. 2 | Comp. Toner 1 | C | B | −15 | B |

The results of Table 2 demonstrate that the developers of Examples 1 to 8, each containing a toner that includes toner base particles treated by supercritical fluid, may provide superior charging properties and higher image densities compared to those of Comparative Examples 1 and 2.

The toner producing methods according to the present invention may be less burdensome to environment. The toners produced by the methods are appropriately utilized for forming high-quality images due to their superior properties in coloring, releasing, charging and surface nature. The developers, toner-containing containers, image forming methods and process cartridges that utilize the toners according to the present invention may be appropriately utilized for forming high-quality images.

What is claimed is:

1. A toner producing method comprising:

preparing toner base particles in an aqueous medium, wherein the toner base particles are resin fine particles;

contacting the toner base particles with a toner functional substance in at least one of supercritical fluids and sub-supercritical fluids; and forming a coating layer on a surface of the toner base particles; wherein the coating layer is formed by attaching or coating a toner functional substance onto the surface of the toner base particles, and the toner functional substance is at least one selected from the group consisting of a colorant, a resin, a charge control agent, a flowability improver and a release agent.

2. The toner producing method according to claim 1, wherein the toner base particles are resin fine particles comprising no colorant.

3. The toner producing method according to claim 1, wherein the toner functional substance is a colorant.

4. The toner producing method according to claim 1, wherein the at least one of supercritical fluids and sub-supercritical fluids dissolves the toner functional substance without substantially dissolving the toner base particles.

5. The toner producing method according to claim 4, wherein the toner functional substance is a colorant.

6. The toner producing method according to claim 1, wherein the coating layer is formed on a partial or entire surface of the toner base particles.

7. The toner producing method according to claim 3, wherein the toner base particles are colored by forming a coating layer on the surface of the toner base particle by contacting the colorant dissolved in the at least one of supercritical fluids and sub-supercritical fluids with the toner base particles.

8. The toner producing method according to claim 1, wherein the toner functional substance is a resin.

9. The toner producing method according to claim 1, wherein the toner functional substance is a charge control agent.

10. The toner producing method according to claim 1, wherein the toner functional substance is a release agent.

11. The toner producing method according to claim 1, wherein the at least one of supercritical fluids and sub-supercritical fluids is a single component or a mixture.

12. The toner producing method according to claim 1, wherein the at least one of supercritical fluids and sub-supercritical fluids comprises carbon dioxide.

13. The toner producing method according to claim 1, wherein the contacting the toner based particles with a toner functional substance in at least one of supercritical fluids and sub-supercritical fluids further comprises an entrainer.

14. The toner producing method according to claim 13, wherein the content of the entrainer is 0.1% by mass to 10% by mass.

15. The toner producing method according to claim 13, wherein the entrainer is a polar organic solvent.

* * * * *

UNITED STATES PATENT AND TRADEMARK OFFICE

CERTIFICATE OF CORRECTION

PATENT NO. : 7,354,690 B2
APPLICATION NO. : 11/522936
DATED : April 8, 2008
INVENTOR(S) : Masayuki Ishii et al.

It is certified that error appears in the above-identified patent and that said Letters Patent is hereby corrected as shown below:

On the title page, Item (75), the third inventor's name should read: -- Naohiro Watanabe --.

Signed and Sealed this

Fifteenth Day of July, 2008

JON W. DUDAS
*Director of the United States Patent and Trademark Office*